US011801413B2

(12) United States Patent
Henniger et al.

(10) Patent No.: US 11,801,413 B2
(45) Date of Patent: Oct. 31, 2023

(54) WEIGHTED BAG

(71) Applicant: Coulter Ventures, LLC., Columbus, OH (US)

(72) Inventors: William Henniger, Columbus, OH (US); Laurie Ann Coughlan, Westerville, OH (US); Ahmik Jones, Upper Arlington, OH (US); Steve Slater, Lancaster, OH (US)

(73) Assignee: Coulter Ventures, LLC., Columbus, OH (US)

( * ) Notice: Subject to any disclaimer, the term of this patent is extended or adjusted under 35 U.S.C. 154(b) by 145 days.

(21) Appl. No.: 17/233,977

(22) Filed: Apr. 19, 2021

(65) Prior Publication Data

US 2022/0032109 A1 Feb. 3, 2022

Related U.S. Application Data

(63) Continuation of application No. 16/213,359, filed on Dec. 7, 2018, now Pat. No. 10,981,030, which is a continuation of application No. 16/103,090, filed on Aug. 14, 2018, now Pat. No. 10,149,997, which is a continuation-in-part of application No. 29/647,410, (Continued)

(51) Int. Cl.

| | |
|---|---|
| ***A63B 21/06*** | (2006.01) |
| *A63B 21/075* | (2006.01) |
| *A63B 21/00* | (2006.01) |

(52) U.S. Cl.

CPC ..... *A63B 21/0603* (2013.01); *A63B 21/06* (2013.01); *A63B 21/0601* (2013.01); *A63B 21/075* (2013.01); *A63B 21/4035* (2015.10)

(58) Field of Classification Search

None

See application file for complete search history.

(56) References Cited

U.S. PATENT DOCUMENTS

D136,996 S 1/1944 Blake
2,616,467 A * 11/1952 Cicero ..... B65D 33/28 383/44

(Continued)

FOREIGN PATENT DOCUMENTS

DE 202014100859 U1 6/2014
WO 2017087423 A1 5/2017

OTHER PUBLICATIONS

Product listing for Rogue Strongman Sandbags from https://web.archive.org/web/20160812070131/https://www.roguefitness.com/rogue-strongman-sandbags , dated Aug. 12, 2016.

(Continued)

*Primary Examiner* — Joshua Lee

(74) *Attorney, Agent, or Firm* — Banner & Witcoff, Ltd.

(57) ABSTRACT

A weighted bag having an outer shell and a handle assembly. The outer shell has a plurality of panels and at least one of one of a pair of slots and a first end loop assembly and a second end loop assembly spaced apart from the first end loop assembly coupled to the plurality of panels. The handle assembly has a handle grasping member and a strapping assembly, the strapping assembly extending from the handle grasping member and interfacing with at least one of the pair of slots and the first and second end loop assemblies so as to couple the handle assembly to the outer shell.

21 Claims, 15 Drawing Sheets

Related U.S. Application Data filed on May 11, 2018, now Pat. No. Des. 864,573, and a continuation-in-part of application No. 29/638,918, filed on Mar. 1, 2018, now Pat. No. Des. 871,072, and a continuation-in-part of application No. 29/651,235, filed on Feb. 16, 2018, now Pat. No. Des. 944,001.

(60) Provisional application No. 62/544,973, filed on Aug. 14, 2017, provisional application No. 62/544,957, filed on Aug. 14, 2017.

(56) References Cited

U.S. PATENT DOCUMENTS

D262,690 S 1/1982 Berry et al.
4,527,796 A * 7/1985 Critelli ..... A63B 69/205 482/901
D281,649 S 12/1985 Bomes et al.
D291,015 S 7/1987 Rumsey
4,802,344 A * 2/1989 Livingston ..... F25D 3/08 62/457.2
5,251,460 A 10/1993 DeMarco et al.
5,413,199 A 5/1995 Clement
5,417,635 A * 5/1995 Sell ..... A63B 21/065 482/148
D368,125 S 3/1996 Wiseman
D372,858 S 8/1996 Sunley
5,584,599 A 12/1996 Knittel
5,593,077 A * 1/1997 Izzo ..... A63B 55/00 224/580
D386,613 S 11/1997 Terzian
D395,751 S 7/1998 Dominique et al.
6,149,555 A 11/2000 Kinback
6,186,662 B1 * 2/2001 Jackson ..... A45C 3/00 383/117
6,217,489 B1 * 4/2001 Nicholson ..... A63B 69/305 482/90
D443,134 S 6/2001 Vazquez
D472,045 S 3/2003 Nieves
6,581,736 B1 6/2003 Scicluna
D485,680 S 1/2004 Hasenfrantz, III
D492,115 S 6/2004 Bertelsen et al.
6,953,277 B2 10/2005 Karslake et al.
D516,307 S 3/2006 Koenig et al.
D526,785 S 8/2006 Brasset
D532,574 S 11/2006 Clark et al.
D554,373 S 11/2007 Fenton et al.
D567,595 S 4/2008 Christopher
D577,483 S 9/2008 Tagliati et al.
D592,854 S 5/2009 Gonzalez
D615,137 S 5/2010 Ivanov
D617,560 S 6/2010 Wu
D636,184 S 4/2011 Scicluna et al.
D647,695 S 11/2011 Enghard
D653,445 S 2/2012 Enghard
D669,314 S 10/2012 Quigley et al.
8,276,351 B1 * 10/2012 Henkin ..... A63B 21/0603 53/469
D672,414 S * 12/2012 Januszek ..... D21/680
D685,440 S 7/2013 Tuttle
8,622,877 B2 * 1/2014 Raines ..... A63B 21/06 383/44
D707,062 S 6/2014 Fraioli
8,894,552 B2 * 11/2014 Wilson ..... A63B 69/20 482/83
D725,723 S 3/2015 Eddie
D726,842 S 4/2015 Ross
D738,444 S 9/2015 Hilson
9,320,938 B1 * 4/2016 Belmore ..... B65D 81/18
D760,495 S 7/2016 Baram
D762,797 S 8/2016 Pajonk-Taylor et al.
9,616,272 B1 * 4/2017 Bennett ..... A63B 23/03525
D792,531 S * 7/2017 Bossier ..... D21/682
D797,392 S 9/2017 Desanti et al.
9,820,514 B2 11/2017 Nykoluk
9,914,002 B2 * 3/2018 Stroup ..... A63B 21/065
D814,180 S 4/2018 Morelli
9,999,798 B2 6/2018 Hannula
D823,953 S 7/2018 Kuka
10,105,566 B2 10/2018 Buikema
10,149,997 B1 12/2018 Henniger et al.
10,252,097 B1 4/2019 Raines
D851,395 S 6/2019 Jusic
10,343,009 B2 * 7/2019 Peyton ..... A63B 21/072
10,350,474 B1 * 7/2019 Magrino ..... A63B 1/00
D864,573 S 10/2019 Jones
D865,354 S 11/2019 Magrino et al.
D868,182 S 11/2019 Catania
D871,072 S 12/2019 Coughlan et al.
D876,558 S 2/2020 Ross
10,561,885 B1 2/2020 Lewis, Jr.
D885,498 S 5/2020 Pecqueur
10,981,030 B2 4/2021 Henniger et al.
D939,827 S 1/2022 Jones
D944,001 S 2/2022 Coughlan
D948,155 S 4/2022 Haas
11,318,345 B2 5/2022 Bassoo
D955,751 S 6/2022 Coughlan et al.
2005/0187075 A1 8/2005 Bellamy
2006/0137950 A1 * 6/2006 Nassanian ..... A45C 7/0063 190/119
2008/0057805 A1 * 3/2008 Alexander ..... B63B 32/87 441/75
2009/0062093 A1 3/2009 Clark
2010/0022361 A1 * 1/2010 Raines ..... A63B 21/0602 141/10
2010/0048363 A1 2/2010 Gilberti et al.
2011/0287904 A1 * 11/2011 Morris ..... A63B 21/0602 482/93
2012/0058863 A1 3/2012 Brizard et al.
2012/0149536 A1 * 6/2012 Trimble ..... A63B 21/00065 53/469
2012/0184418 A1 * 7/2012 Wilson ..... A63B 21/022 482/112
2012/0246884 A1 * 10/2012 Wilson ..... A63B 69/004 24/302
2013/0274080 A1 10/2013 Matsushita
2013/0343675 A1 12/2013 Gourchounian
2014/0226919 A1 8/2014 Fu et al.
2015/0061245 A1 3/2015 Rogier
2015/0182777 A1 * 7/2015 Rarity, IV ..... A63B 21/0602 482/93
2015/0202486 A1 * 7/2015 Childs ..... A63B 21/0603 482/106
2016/0129292 A1 * 5/2016 Stroup ..... A63B 23/12 434/247
2016/0317854 A1 11/2016 Stoddard
2017/0036056 A1 2/2017 Tomellini et al.
2018/0085619 A1 3/2018 Chen
2019/0184252 A1 6/2019 Raines
2019/0269956 A1 9/2019 Henniger et al.
2019/0299046 A1 10/2019 Tomellini et al.

OTHER PUBLICATIONS

Photos of shoulder carry bag available at https://www.roguefitness.com/rogue-feed-sack, dated Sep. 21, 2018, product available at least as early as Jul. 27, 2014.

Photos of Rogue Sandbags available at https://www.roguefitness.com/rogue-sandbags, dated Sep. 21, 2018, product available at least as early as Apr. 12, 2016.

Product listing for Rogue Sandbags from http://web.archiveorg/web/20160412084703/http://www.roguefitness.com:80/rogue-sandbags dated Apr. 12, 2016.

Product listing for Wreck Bag from https://www.roguefitness.com/wreck-bag, dated Sep. 21, 2018, product available at least as early as Aug. 13, 2016.

Product listing for Wreck Bag Mini from https://www.roguefitness.com/wreck-bag-mini, dated Sep. 21, 2018, product available at least as early as Dec. 13, 2016.

(56) References Cited

OTHER PUBLICATIONS

Product listing for StrongFit Classic Sandbags from https://www.roguefitness.com/strongfit-classic-sandbags, dated Sep. 21, 2018, product available at least as early as Aug. 13, 2016.
Web page from https://web.archive.org/web/20160808024400/http://www.roguefitness.com:80/conditioning/strength-equipment/sandbags , dated Aug. 8, 2016.
Product listing for Rogue Tactical Sandbags from https://web.archive.org/web/20150331060530/http://www.roguefitness.com:80/tactical-sandbags , dated Mar. 31, 2015.
Photos of product taken Sep. 20, 2018, product known to be available earlier than Aug. 13, 2016.
Feb. 5, 2019—(WO) International Search Report and Written Opinion—App PCT/US2018/046716.
"2017 Arnold Strongman Classic—Weight Over Bar/4K" (Rogue Fitness) Mar. 6, 2017 (Mar. 6, 2017) [online] retrieved from <URL: https://www.youtube.com/watch?v=tJUa5qIMOoA> entire document, especially demonstration 0:25-0:34, 4:50.
"Rogue Sandbags" (Rogue Fitness) Jun. 20, 2017 (Jun. 20, 2017) [online] retrieved from <URL: http://www.roguecanada.ca:80/rogue-sandbags>entire document.
Product listing for Rogue Strongman Throw Bag from <https://www.roguefitness.com/rogue-strongman-throwbag>, dated Mar. 29, 2020, product disclosed at least as early as May 30, 2018.
Product listing for Rogue Cyclone Strongman Sandbags from <https://www.roguefitness.com/rogue-cyclone-strongman-sandbags>, dated Mar. 29, 2020, product disclosed at least as early as Mar. 16, 2018.
Product listing for Rogue Feed Sack from <https://www.roguefitness.com/rogue-feed-sack>, dated Mar. 29, 2020, product disclosed at least as early as May 16, 2018.
Ludus Imperium Strongman sandbag, Heavy Duty Workout sandbags for Training, Fitness, cross-training & Exercise, Workouts, Sandbag Weights; (<https://www.amazon.co.uk/Ludus-Imperium-Strongman-Sandbags-Cross-training/dp/B07F1YP89Y/ref=sr_1_5?dchild=1&keywords=rogue%2Bcyclone%2Bsandbag&qid=1616886133&sr=8-5&th=1 >), access date Apr. 30, 2021.
Rogue Cyclone Sandbags, (https://www.roguefitness.com/rogue-cyclone-strongman-sandbags), Available 2018.
Just Launched. Rogue Cyclone Strongman Sandbags & Rogue Fanny Pack!; https://emailtuna.com/roguefitness.com/106880, dated Feb. 16, 2018.
Product listing for Rogue Sandbags from <http://web.archive.org/web/20190202190945/https:/www.roguefitness.com/rogue-sandbags>, dated Aug. 6, 2015.
Product listing for Rogue Strongman Sandbags 100LBS-400LBS from http://web.archive.org/web/20210212005140/https://www.roguefitness.com/rogue-strongman-sandbags, dated Feb. 12, 2021.
Apr. 19, 2021—(EP) EESR—App 18846134.7.
Feb. 15, 2023—(EP) Office Action—App 18846134.7.

* cited by examiner

WEIGHTED BAG

CROSS-REFERENCE TO RELATED APPLICATION

This application is a continuation of co-pending U.S. patent application Ser. No. 16/213,359, filed Dec. 7, 2018, which is a continuation of U.S. patent application Ser. No. 16/103,090, filed Aug. 14, 2018, and issued as U.S. Pat. No. 10,149,997 on Dec. 11, 2018, which is a non-provisional of and claims priority to U.S. Provisional Application No. 62/544,973, filed Aug. 14, 2017, and U.S. Provisional Application No. 62/544,957, filed Aug. 14, 2017, and which also claims priority to and is a continuation-in-part of U.S. Design patent application No. Ser. 29/651,235, filed Feb. 16, 2018, U.S. Design patent application Ser. No. 29/638,918, filed Mar. 1, 2018, and issued as U.S. Design Pat. No. D871,072 on Dec. 31, 2019, and U.S. Design patent application Ser. No. 29/647,410, filed May 11, 2018, and issued as U.S. Design Pat. No. D864,573 on Oct. 29, 2019, and the present application claims priority to all of such prior applications, which are all incorporated herein by reference and made part hereof.

BACKGROUND OF THE DISCLOSURE

1. Field of the Disclosure

The disclosure relates in general to weightlifting devices, and more particularly, to a weighted bag for use in various weightlifting and other exercises.

2. Background Art

The use of different devices in the lifting of weights and general exercising is well known in the art. Many such exercises and lifts generally utilize a rigid or solid weight that is coupled to a handle, a bar or a cable and pulley system. Such devices include lat machines, barbells, kettlebells, dumbbells and the like.

Increasingly, however, dynamic, or shape changing devices have been utilized. These devices include, but are not limited to shape changing platforms, such as hemispherically shaped structures which are semi-rigid, inflatable structures and the like. Other such devices include balls or bags that can be lifted, carried, thrown or otherwise manipulated.

Problematically, these non-rigid, flexible devices tend to experience unpredictable forces and non-uniform loading depending on how they are manipulated and/or how they are grasped, dropped or otherwise impacted. At the same time, the material from which such devices are made, by definition, are generally flexible and capable of shape changing. Moreover, where a handle or the like is introduced, the coupling of the handle to the bag is problematic and often a source of deterioration, degradation and failure of the bag. For example openings, tears, rips and the like are often formed proximate the stitching or other joining between the handle and the bag panels, as stress concentrations are experienced in such locations.

BRIEF SUMMARY

The disclosure generally relates to various embodiments of a bag having an outer shell defining an inner cavity configured to receive a filler material to create a weighted bag. Any of the embodiments herein may further include an inner bag positioned in the inner cavity and connected to an inner surface of the shell, which is configured to be filled with the filler material, e.g., by being in communication with an opening in the shell.

Aspects of the disclosure relate to a bag configured to be filled with a filler material that includes a shell having a cylindrical portion with a circular cylindrical shape and opposed circular ends connected to the cylindrical portion, where the cylindrical portion and the ends of the shell combine to define and enclose an inner cavity, and where the shell has an opening providing access to the inner cavity and a closure mechanism configured for selectively opening and closing the opening, an inner bag positioned in the inner cavity and connected to an inner surface of the shell, a filling mechanism, and a handle assembly. The inner bag is in communication with the opening and is configured to be filled with the filler material through the opening. The filling mechanism includes a funnel having a proximal end connected to the inner surface of the shell and a distal end defining an inlet in communication with the inner bag, where the funnel is flexible and is configured to be extendible by extending the distal end outward through the opening for filling the filler material into the inner bag through the opening and collapsible by collapsing the funnel within the opening. The filling mechanism further includes a funnel closure and a funnel securing structure, the funnel closure having a first engaging portion and a second engaging portion positioned on inner surfaces of opposite sides of the funnel proximate the distal end and configured to releasably engage each other to close the inlet, and the funnel securing structure having a first securing member and a second securing member positioned on outer surfaces of the funnel at different distances from the distal end, with the first and second securing members configured to releasably engage each other to secure the funnel in a collapsed position. The handle assembly includes a handle configured to be grasped by a user and first and second strap portions engaged with the handle and extending from the handle to engage the cylindrical portion of the shell. The first strap portion extends around at least a first portion of a circumference of the cylindrical portion in a first circumferential direction, and the second strap portion extends around at least a second portion of the circumference of the cylindrical portion in a second circumferential direction. The opening may be defined in the cylindrical portion of the shell in one configuration, but may be located in a different portion of the shell.

According to one aspect, the first and second strap portions are non-fixedly engaged with the handle and/or non-fixedly engaged with the shell.

According to another aspect, the handle has a central passage, and the first and second strap portions extend into the central passage of the handle.

According to a further aspect, the filling mechanism further includes a pair of grasping handles connected to opposite sides of the funnel proximate the distal end and configured for grasping by the user.

According to yet another aspect, the first and second strap portions combine to extend around the entire circumference of the cylindrical portion and are connected together at a joint to form a circumferential strap engaged with the handle.

According to a still further aspect, the cylindrical portion of the shell is formed by a single cylindrical panel of a fabric material, and each of the opposed ends is formed of a single circular panel of the fabric material.

Additional aspects of the disclosure relate to a bag that includes a shell having a cylindrical portion having a circular cylindrical shape and opposed ends connected to the cylindrical portion and each having a circular shape, where the cylindrical portion and the ends of the shell combine to define and enclose an inner cavity, and where the shell has an opening providing access to the inner cavity and a closure mechanism configured for selectively opening and closing the opening, and further includes an inner bag positioned in the inner cavity and connected to an inner surface of the shell, where the inner bag is in communication with the opening and is configured to be filled with the filler material through the opening, a filling mechanism, and a handle assembly. The filling mechanism includes a funnel having a proximal end connected to the inner surface of the shell and a distal end defining an inlet in communication with the inner bag, where the funnel is flexible and is configured to be extendible by extending the distal end outward through the opening for filling the filler material into the inner bag through the opening and collapsible by collapsing the funnel within the opening. The filling mechanism further includes a funnel closure and a funnel securing structure, the funnel closure having a first engaging portion and a second engaging portion positioned on inner surfaces of opposite sides of the funnel proximate the distal end and configured to releasably engage each other to close the inlet, and the funnel securing structure has a first securing member and a second securing member positioned on outer surfaces of the funnel at different distances from the distal end, with the first and second securing members configured to releasably engage each other to secure the funnel in a collapsed position. The handle assembly includes a handle configured to be grasped by a user, and first and second strap portions engaged with the handle and extending from a first end of the handle to engage the cylindrical portion of the shell. The first strap portion extends circumferentially around at least a first portion of the cylindrical portion, and the second strap portion extends circumferentially around at least a second portion of the cylindrical portion, where the first strap portion and the second strap portion are parts of a continuous strap extending through the handle from the first end to the second end. The opening may be defined in the cylindrical portion of the shell in one configuration, but may be located in a different portion of the shell.

According to one aspect, the first and second strap portions are non-fixedly engaged with the handle and/or are non-fixedly engaged with the shell.

According to another aspect, the cylindrical portion of the shell is formed by a single cylindrical panel of a fabric material, and each of the opposed ends is formed of a single circular panel of the fabric material.

According to a further aspect, the continuous strap may be a single, integral strap that extends through the handle from the first end to the second end.

Further aspects of the disclosure relate to a bag that includes a shell having a cylindrical portion, a first end, and a second end opposite the first end, where the cylindrical portion and the first and second ends of the shell combine to define and enclose an inner cavity configured to contain the filler material, and where the shell has an opening providing access to the inner cavity for filling the filler material into the inner cavity, and further includes a handle assembly. The handle assembly includes a handle configured to be grasped by a user, a first peripheral strap engaged with the handle and extending from the handle around a periphery of the cylindrical portion proximate the first end to engage the shell, and a second peripheral strap engaged with the handle and extending from the handle around the periphery of the cylindrical portion proximate the second end to engage the shell. The handle assembly further includes a central strap extending from the handle around the first end, a portion of the cylindrical portion, and the second end to engage the shell.

According to one aspect, the cylindrical portion has a circular cylindrical shape, the first and second ends are circular in shape, and the first and second peripheral straps are circumferential straps that extend around a circumference of the cylindrical portion.

According to a further aspect, the first peripheral strap extends from a first end of the handle in first and second opposed peripheral directions, the second peripheral strap extends from a second end of the handle opposite the first end in the first and second peripheral directions, and the central strap extends from the first end and the second end of the handle.

According to yet another aspect, the handle is positioned above a top of the shell, and the central strap extends across the portion of the cylindrical portion on a bottom of the shell.

According to a still further aspect, the first peripheral strap includes a first strap portion extending in a first peripheral direction from the handle and a second strap portion extending in a second peripheral direction from the handle that is opposite to the first peripheral direction, where the first and second strap portions are connected at a first joint spaced from the handle to form the first peripheral strap. In this configuration, the second peripheral strap includes a third strap portion extending in the first peripheral direction from the handle and a fourth strap portion extending in the second peripheral direction from the handle, where the third and fourth strap portions are connected at a second joint spaced from the handle to form the second peripheral strap.

According to an additional aspect, the first peripheral strap, the second peripheral strap, and the central strap all non-fixedly engage the shell and are moveable with respect to the shell. In one configuration, the first end of the shell has a first slot and the second end of the shell has a second slot, and the central strap extends through the first slot and the second slot to retain the central strap in non-fixed engagement with the shell. The bag may also include a first retaining structure including a first channel extending at least partially around the periphery of the cylindrical portion proximate the first end, and a second retaining structure including a second channel extending at least partially around the periphery of the cylindrical portion proximate the second end, where the first circumferential strap extends through the first channel and the second circumferential strap extends through the second channel to retain the first and second circumferential straps in non-fixed engagement with the shell.

Still further aspects of the disclosure relate to bag configured to be filled with a filler material that includes a shell having a cylindrical portion having a circular cylindrical shape and opposed first and second ends connected to the cylindrical portion and each having a circular shape, where the cylindrical portion and the first and second ends of the shell combine to define and enclose an inner cavity configured to contain the filler material, and where the shell has an opening providing access to the inner cavity for filling the filler material into the inner cavity, as well as a handle assembly and first and second loop assemblies engaged with the handle and the shell. The handle assembly includes a handle configured to be grasped by a user and having first and second opposed handle ends, a first circumferential strap engaged with the handle and extending from the first handle end around a circumference of the cylindrical portion proximate the first handle end to engage the shell, and a second circumferential strap engaged with the handle and extending from the second handle end around the circumference of the cylindrical portion proximate the second handle end to engage the shell. The first loop assembly defines a first channel extending at least partially around the circumference of the cylindrical portion proximate the first end and includes a plurality of first cross supports extending across the first channel, where the first circumferential strap is received in the first channel and the first cross supports engage the first circumferential strap to retain the first circumferential strap in non-fixed engagement with the shell. The second loop assembly defines a second channel extending at least partially around the circumference of the cylindrical portion proximate the second end and includes a plurality of second cross supports extending across the second channel, where the second circumferential strap is received in the second channel and the second cross supports engage the second circumferential strap to retain the second circumferential strap in non-fixed engagement with the shell.

According to one aspect, the first circumferential strap includes a first strap portion extending in a first circumferential direction from the first handle end and a second strap portion extending in a second circumferential direction that is opposite to the first peripheral direction from the first handle end, where the first and second strap portions are connected at a first joint spaced from the handle to form the first circumferential strap. The second circumferential strap includes a third strap portion extending in the first circumferential direction from the second handle end and a fourth strap portion extending in the second circumferential direction from the second handle end, where the third and fourth strap portions are connected at a second joint spaced from the handle to form the second circumferential strap. In one configuration, the first strap portion and the third strap portion are formed as a first integral strap that extends through the handle from the first handle end to the second handle end, and the second strap portion and the fourth strap portion are formed as a second integral strap that extends through the handle from the first handle end to the second handle end.

According to a further aspect, the first cross supports are arranged in a first alternating pattern and extend at oblique angles across the first channel, and the second cross supports are arranged in a second alternating pattern and extend at oblique angles across the second channel. In one configuration, the first cross supports and the second cross supports form triangular gaps between adjacent cross supports of the first cross supports and the second cross supports. In an additional configuration, each of the first cross supports overlaps with adjacent first cross supports, and each of the second cross supports overlaps with adjacent second cross supports. In a further configuration, all of the plurality of first cross supports are connected to the shell along first and second continuous circumferential seams that are spaced from each other and located on opposite sides of the first channel, and all of the plurality of second cross supports are connected to the shell along third and fourth continuous circumferential seams that are spaced from each other and located on opposite sides of the second channel. In this of another configuration, the first loop assembly may further include a first circumferential support connected to the shell and extending at least partially around the shell between the first cross supports and the shell, such that the first channel is defined between the first cross supports and the first circumferential support, and the second loop assembly may further include a second circumferential support connected to the shell and extending at least partially around the shell between the second cross supports and the shell, such that the second channel is defined between the second cross supports and the second circumferential support. The first and second continuous circumferential seams may also connect the first circumferential support to the shell, and the third and fourth continuous circumferential seams may also connect the second circumferential support to the shell in this configuration. In yet another configuration, the first and second cross supports are oriented such that adjacent first cross supports and adjacent second cross supports are angled at 60-70° with each other.

Other aspects of the disclosure relate to a bag configured to be filled with a filler material, including a shell having a cylindrical portion having a circular cylindrical shape and opposed first and second ends connected to the cylindrical portion and each having a circular shape, where the cylindrical portion and the first and second ends of the shell combine to define and enclose an inner cavity configured to contain the filler material, and where the shell has an opening providing access to the inner cavity for filling the filler material into the inner cavity, as well as a handle assembly and first and second retaining structures engaged with the handle and the shell. The handle assembly includes a handle configured to be grasped by a user and having first and second opposed handle ends, a first circumferential strap engaged with the handle and extending from the first handle end at least partially around a circumference of the cylindrical portion proximate the first handle end to engage the shell, and a second circumferential strap engaged with the handle and extending from the second handle end at least partially around the circumference of the cylindrical portion proximate the second handle end to engage the shell. The first retaining structure includes a first channel extending circumferentially at least partially around the cylindrical portion proximate the first end, where the first circumferential strap extends through the first channel to retain the first circumferential strap in non-fixed engagement with the shell. The second retaining structure includes a second channel extending circumferentially at least partially around the cylindrical portion proximate the second end, wherein the second circumferential strap extends through the second channel to retain the second circumferential strap in non-fixed engagement with the shell.

According to one aspect, the first circumferential strap includes a first strap portion extending in a first circumferential direction from the first handle end and a second strap portion extending in a second circumferential direction that is opposite to the first peripheral direction from the first handle end, where the first and second strap portions are connected at a first joint spaced from the handle to form the first circumferential strap. The second circumferential strap includes a third strap portion extending in the first circumferential direction from the second handle end and a fourth strap portion extending in the second circumferential direction from the second handle end, where the third and fourth strap portions are connected at a second joint spaced from the handle to form the second circumferential strap. In one configuration, the first strap portion and the third strap portion are formed as a first integral strap that extends through the handle from the first handle end to the second handle end, and the second strap portion and the fourth strap portion are formed as a second integral strap that extends through the handle from the first handle end to the second handle end.

According to a further aspect, the first retaining structure includes a plurality of first cross supports extending across the first channel, such that the first cross supports engage the first circumferential strap to retain the first circumferential strap in the non-fixed engagement with the shell, and the second retaining structure includes a plurality of second cross supports extending across the second channel, such that the second cross supports engage the second circumferential strap to retain the second circumferential strap in non-fixed engagement with the shell.

According to yet another aspect, the first cross supports are arranged in a first alternating pattern and extend at oblique angles across the first channel, and the second cross supports are arranged in a second alternating pattern and extend at oblique angles across the second channel.

Other aspects of the disclosure relate to a bag configured to be filled with a filler material, including a shell having a cylindrical portion having a circular cylindrical shape and opposed first and second ends connected to the cylindrical portion and each having a circular shape, where the cylindrical portion and the first and second ends of the shell combine to define and enclose an inner cavity configured to contain the filler material, where the shell has an opening providing access to the inner cavity for filling the filler material into the inner cavity, as well as a handle assembly engaged with the shell. The first end includes a first outer panel on an outer surface of the shell and a first inner panel on an inner surface of the shell, with a first slot defined between the first outer and inner panels, and the second end includes a second outer panel on the outer surface of the shell and a second inner panel on the inner surface of the shell, with a second slot defined between the second outer and inner panels. The handle assembly includes a handle configured to be grasped by a user and having first and second opposed handle ends, and a central strap engaging the handle and extending from the first handle end around the first end of the shell and through the first slot, across a bottom of the cylindrical portion, and around the second end of the shell and through the second slot. The central strap extends through the first and second slots retains the central strap in non-fixed engagement with the shell.

According to one aspect, the central strap includes a first strap portion extending from the first handle end around the first end of the shell and through the first slot, and at least partially across the bottom of the shell, and a second strap portion extending from the second handle end around the second end of the shell and through the second slot, and at least partially across the bottom of the shell, where the first and second strap portions are connected at a joint spaced from the handle to form the central strap. In one configuration, the first strap portion and the second strap portion are formed as a single, integral strap that extends through the handle from the first handle end to the second handle end.

According to another aspect, the first slot has a first upper opening and a first lower opening in the first outer panel, such that the central strap extends through the first upper and lower openings, and the second slot has a second upper opening and a second lower opening in the second outer panel, such that the central strap extends through the second upper and lower openings.

Other aspects of the disclosure relate to a bag configured to be filled with a filler material, including a shell having a central body portion and opposed top and bottom ends connected to the central body portion, where the central body portion and the top and bottom ends of the shell combine to define and enclose an inner cavity configured for containing the filler material. The central body portion has a tapered shape such that at least one of a minimum width and a perimeter of the central body portion is smaller at the bottom end and larger at the top end, and the bottom end is smaller than the top end, and wherein the shell has an opening providing access to the inner cavity.

According to one aspect, the central body portion has a frusto-conical shape, and the top and bottom ends have circular shapes, such that the minimum width of the central body portion is a diameter, and the perimeter of the central body portion is a circumference.

According to another aspect, a ratio of a minimum width of the top end to a minimum width of the bottom end is 1.25:1-2:1. In one configuration, the ratio of the minimum width of the top end to the minimum width of the bottom end is 1.5:1-1.75:1.

According to a further aspect, a ratio of a surface area of the top end to a surface area of the bottom end is 1.5:1-4:1. In one configuration, the ratio of the surface area of the top end to the surface area of the bottom end is 2.25:1-3:1.

According to yet another aspect, the central body portion has a taper angle of 6-10° with respect to a central axis of the bag. In one configuration, the taper angle of the central body portion with respect to the central axis of the bag is 7-9°.

According to a still further aspect, the central body portion has a cross-sectional area taken perpendicular to a central axis of the bag that is smaller at the bottom end and larger at the top end.

Other aspects of the disclosure relate to a bag configured to be filled with a filler material, including a shell having a central body portion that is elongated between opposed first and second ends and has a top and a bottom extending between the first and second ends, where the central body portion and the first and second ends of the shell combine to define and enclose an inner cavity configured for containing the filler material, and where the shell has an opening providing access to the inner cavity and a closure mechanism configured for selectively opening and closing the opening, as well as a handle assembly engaged with the shell. The handle assembly includes a first gripping member connected to the shell proximate a first juncture between the top and the first end and a second gripping member connected to the shell proximate a second juncture between the top and the second end. The first gripping member extends outward from the shell at an oblique angle to at least one of the top, the first end, and the lateral centerline, and the second gripping member extends outward from the shell at an oblique angle to at least one of the top, the second end, and the lateral centerline.

According to one aspect, the first gripping member includes a first loop having ends connected to front and rear sides of the shell, and the second gripping member includes a second loop having ends connected to the front and rear sides of the shell.

According to another aspect, the shell is formed of a single panel extending around front and rear sides of the shell and connected to itself by seams at the first and second ends and a lateral seam extending between the first and second ends. In one configuration, the lateral seam extends across the rear side of the shell, and the opening is defined on the front side of the shell.

According to a further aspect, the handle assembly further includes a first base connected to the shell and extending on the front side and the rear side of the shell and having a first crossing portion extending over the top between the front side and the rear side proximate a first juncture between the top and the first end, and a second base connected to the shell and extending on the front side and the rear side and having a second crossing portion extending over the top between the front side and the rear side proximate a second juncture between the top and the second end. The first gripping member is connected to the first base and extends outward from the first base, and the second gripping member is connected to the second base and extends outward from the second base. In one configuration, the first crossing portion has a first inner edge and the second crossing portion has a second inner edge, and the first and second inner edges each form angles of 80-100° with the top of the shell.

According to yet another aspect, the shell has a rectangular shape defined by the top, the bottom, and the first and second ends, and/or the shell is configured to have an oval shape when viewed from the first or second end when filled.

According to a still further aspect, the shell has a length measured between the first and second ends and a height measured between the top and the bottom, and the length is at least two times the height.

Other aspects of the disclosure relate to a bag configured to be filled with a filler material, including a shell having a front side and a back side and having a central body portion and opposed first and second ends, the central body portion having a top and a bottom extending between the first and second ends, where the central body portion and the first and second ends of the shell combine to define and enclose an inner cavity configured for containing the filler material, and where the shell has an opening providing access to the inner cavity, as well as a handle assembly engaged with the shell. The handle assembly includes a first base connected to the shell and extending on the front side and the rear side and having a first crossing portion extending over the top between the front side and the rear side proximate a first juncture between the top and the first end, a first gripping member connected to the first base and extending outward from the first base, a second base connected to the shell and extending on the front side and the rear side and having a second crossing portion extending over the top between the front side and the rear side proximate a second juncture between the top and the second end, and a second gripping member connected to the second base and extending outward from the second base. The first crossing portion has a first inner edge and the second crossing portion has a second inner edge, and the first and second inner edges each form angles of 80-100° with the top of the shell.

According to one aspect, the first base further includes a first front angling portion extending on the front side of the shell to the top of the shell at oblique angles to the first end and the top of the shell and a first rear angling portion extending on the rear side of the shell to the top of the shell at oblique angles to the first end and the top of the shell, where the first crossing portion extends between the first front angling portion and the first rear angling portion. In one configuration, the first front angling portion extends on the front side of the shell from the first end to the top of the shell, and the first rear angling portion extends on the rear side of the shell from the first end to the top of the shell. In an additional configuration, the second base further includes a second front angling portion extending on the front side of the shell from the second end to the top of the shell at oblique angles to the second end and the top of the shell and a second rear angling portion extending on the rear side of the shell from the second end to the top of the shell at oblique angles to the second end and the top of the shell, where the second crossing portion extends between the second front angling portion and the second rear angling portion. In a further configuration, the first crossing portion forms juncture angles with the first front angling portion and the first rear angling portion that are 110-140°. In yet another configuration, the first crossing portion has a first width between the first inner edge and a first outer edge of the first crossing portion, and the first front angling portion and the first rear angling portion have widths defined between inner and outer edges thereof, where the first width is smaller than the widths of the first front angling portion and the first rear angling portion. In a still further configuration, the first base is formed of a continuous panel, and the first base is folded over itself at the first crossing portion, such that a first surface of the continuous panel forms an outer surface of the first front angling portion and an inner surface of the first rear angling portion.

According to another aspect, the shell has a lateral centerline extending between the first and second ends, where the first gripping member extends outward from the first base at an oblique angle to at least one of the top, the first end, and the lateral centerline, and the second gripping member extends outward from the first base at an oblique angle to at least one of the top, the second end, and the lateral centerline.

According to a further aspect, the first gripping member includes a first loop having ends connected to the first base on the front and rear sides of the shell and the second gripping member includes a second loop having ends connected to the second base on the front and rear sides of the shell.

According to yet another aspect, the shell is formed of a single panel extending around the front and rear sides and connected to itself by seams at the first and second ends and a lateral seam extending between the first and second ends. In one configuration the lateral seam extends across the rear side of the shell, and the opening is defined on the front side of the shell.

According to a still further aspect, the shell has a rectangular shape defined by the top, the bottom, and the first and second ends, and/or the shell is configured to have an oval shape when viewed from the first or second end when filled.

Other features and advantages of the disclosure will be apparent from the following description taken in conjunction with the attached drawings.

BRIEF DESCRIPTION OF THE DRAWINGS

The disclosure will now be described with reference to the drawings wherein.

DETAILED DESCRIPTION OF THE DISCLOSURE

Figure 1:
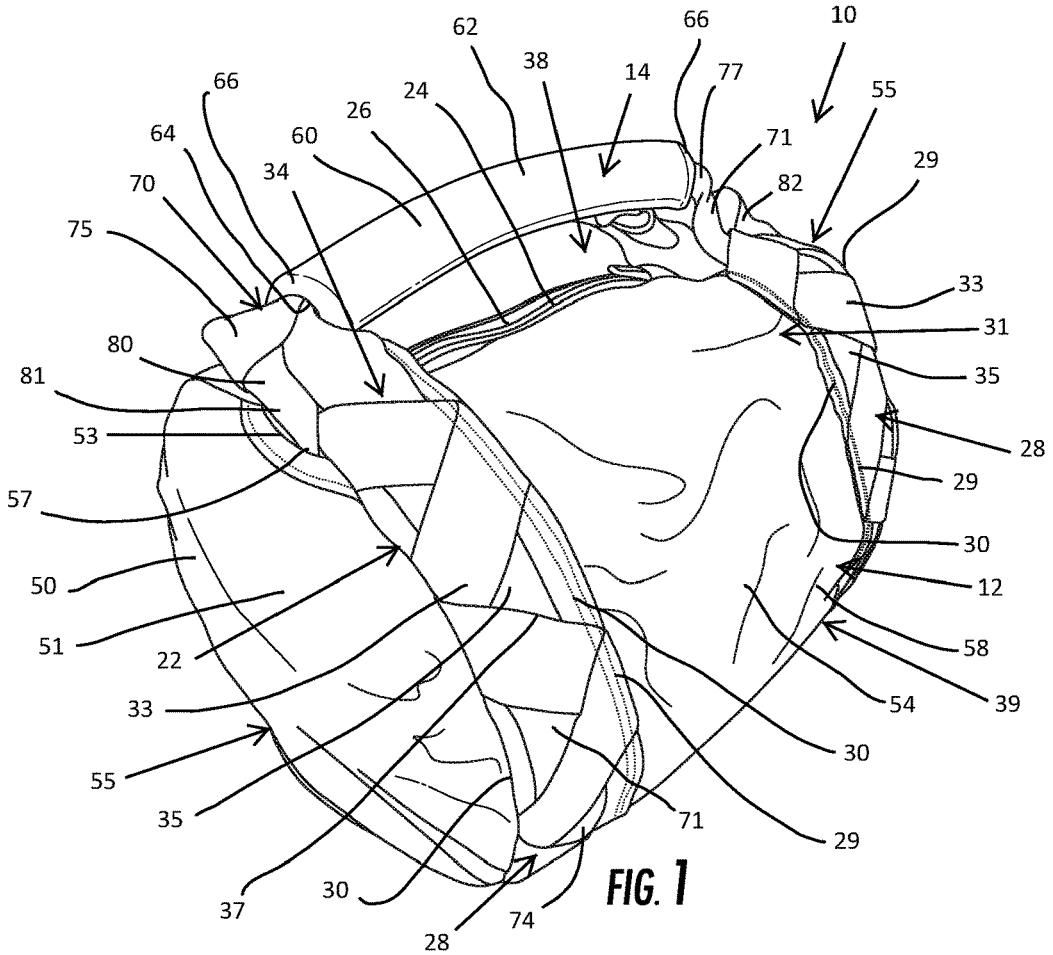
FIG. 1 is a front perspective view of one embodiment of a weighted bag according to aspects disclosed herein.
Figure 2:
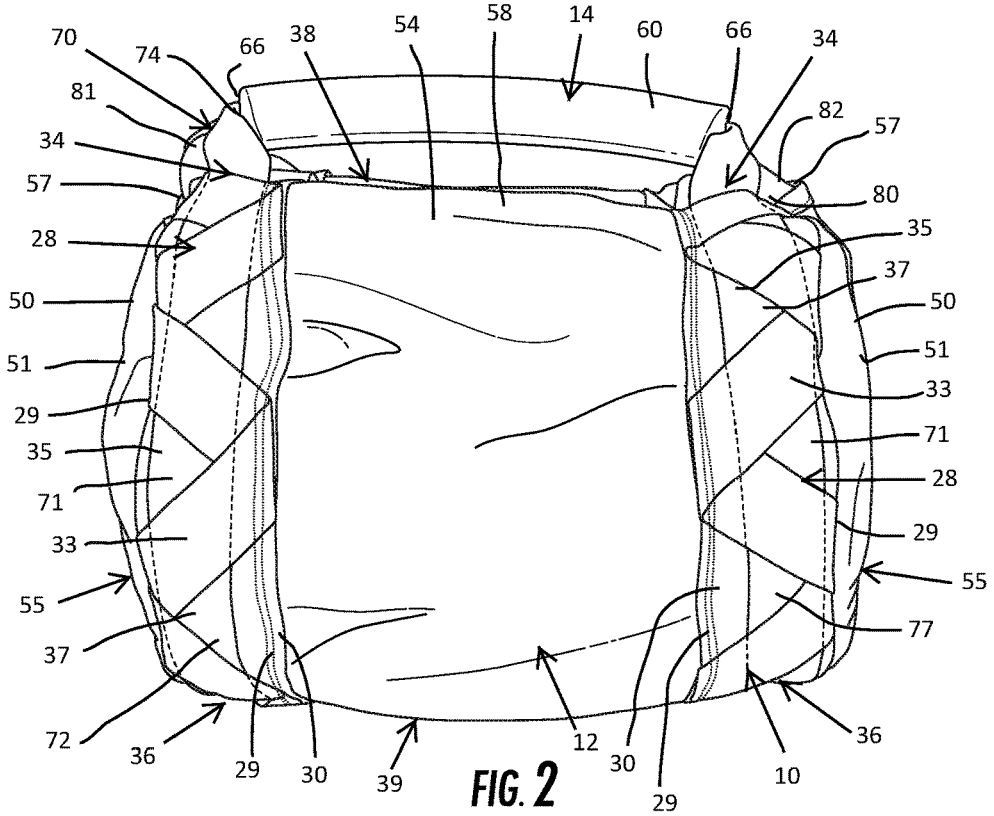
FIG. 2 is a front elevation view of the weighted bag of FIG. 1.
Figure 3:
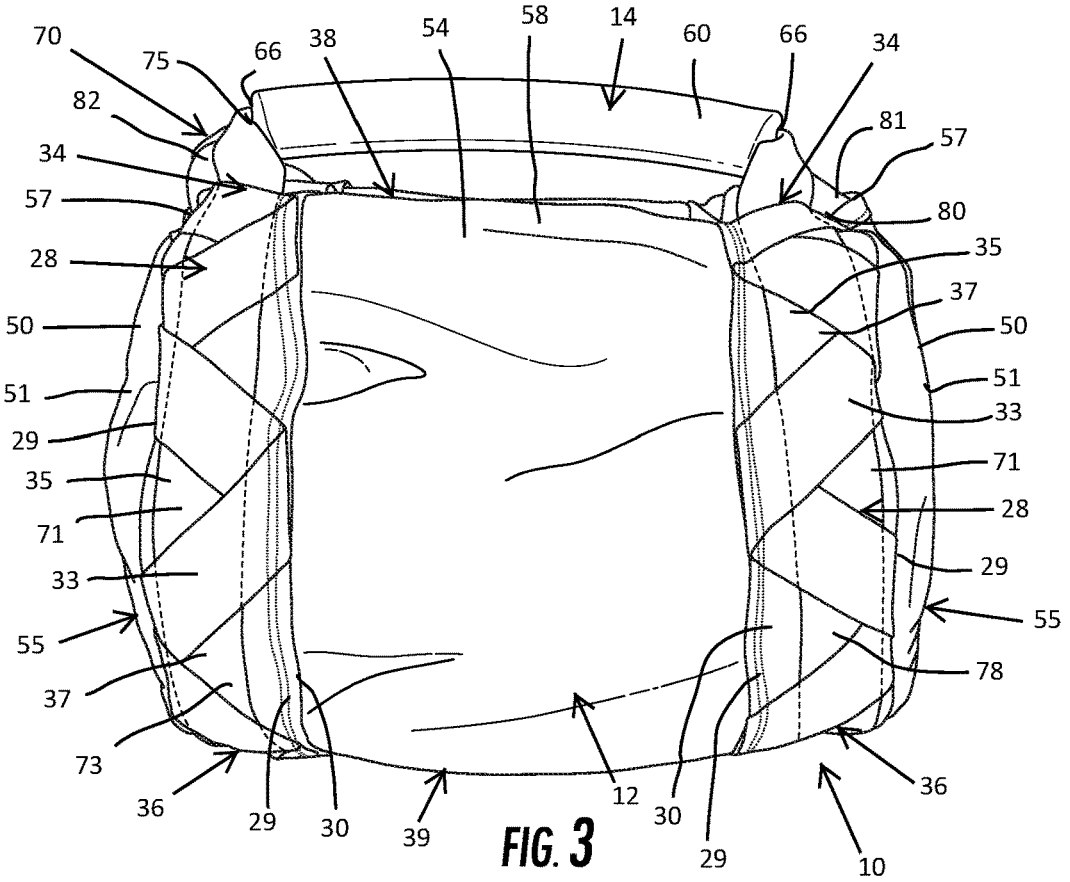
FIG. 3 is a rear elevation view of the weighted bag of FIG. 1.
Figure 4:
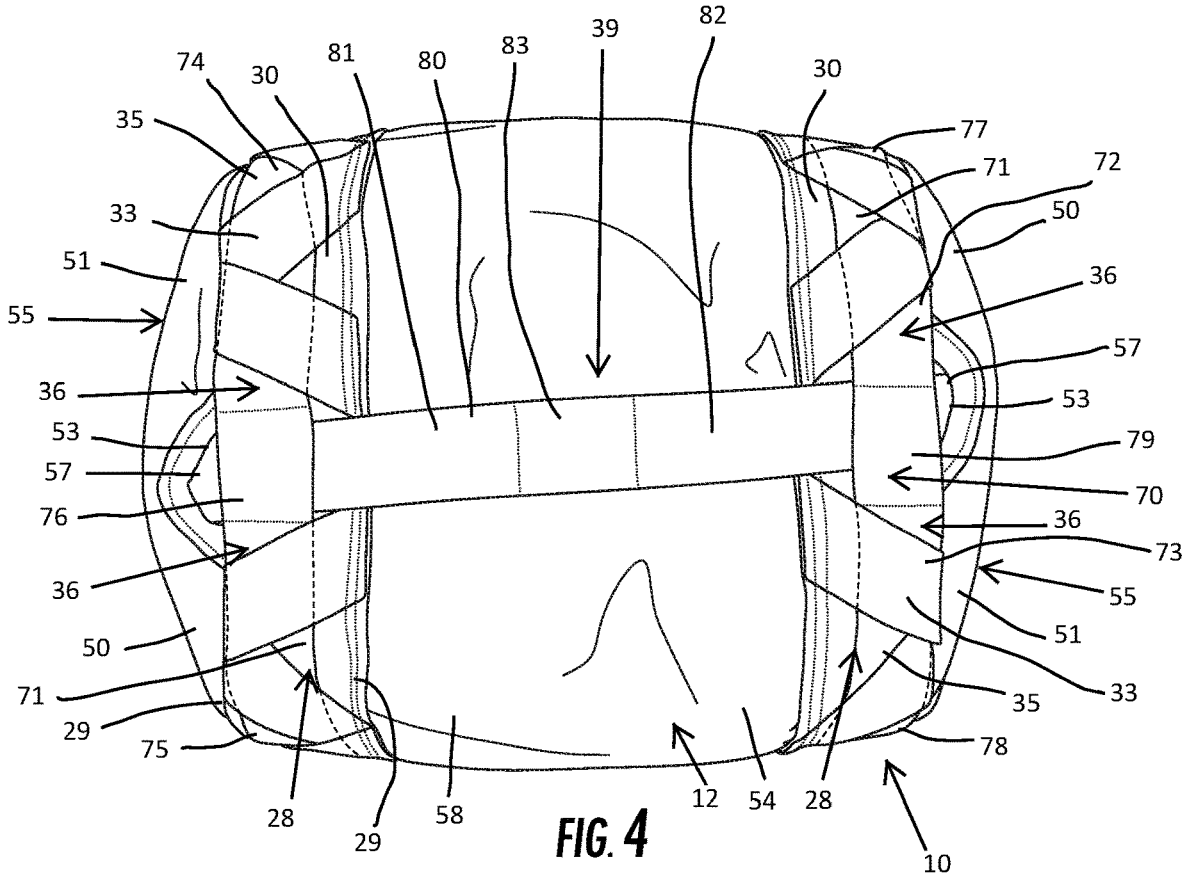
FIG. 4 is a bottom elevation view of the weighted bag of FIG. 1.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1-8, a weighted bag with a handle for weightlifting is shown generally at reference number 10. The weighted bag 10 includes an outer shell 12 and handle assembly 14. The handle assembly 14 is coupled to the outer shell 12 by two or more points along the weighted bag 10, such as by a strap assembly 70 as described herein. The weighted bag 10 as shown in FIGS. 1-8 is configured for weightlifting and similar exercises, and can be lifted, carried, thrown, dropped, and otherwise used to enhance strength, agility and the like.

The outer shell 12, shown in FIGS. 1-8, comprises one or more panels 20 that are connected by one or more seams 22, an opening 24 with a shell closure member 26. Each of the panels 20 has an inner surface 31 defining an inner cavity 21 configured to hold a filler material 16 and an outer surface 32 opposite the inner surface 31. The shell 12 has a top 38 and a bottom 39, such that the opening 24 is positioned on the top 38, and the bag 10 is configured to rest on the bottom 39. It is understood that the top 38 and the bottom 39 are relative terms that depend on the orientation of the bag 10.

It is to be understood the inner surface 31 and outer surface 32 of the panels 20 may be defined by one or more surfacing layers that may be of substantially equal or variable materials. Generally, these are two or greater ply configuration coupled together. In the configuration shown, the panels are shown as singular pieces with the understanding that they may represent multiple plies of material. In one embodiment, the panels 20 are formed from a two ply construction, with the outer and inner plies comprising different grades of ballistic nylon fabric (the outside being of 1000 denier and the inside being of 500 denier). Of course, other configurations are contemplated.

Figure 5:
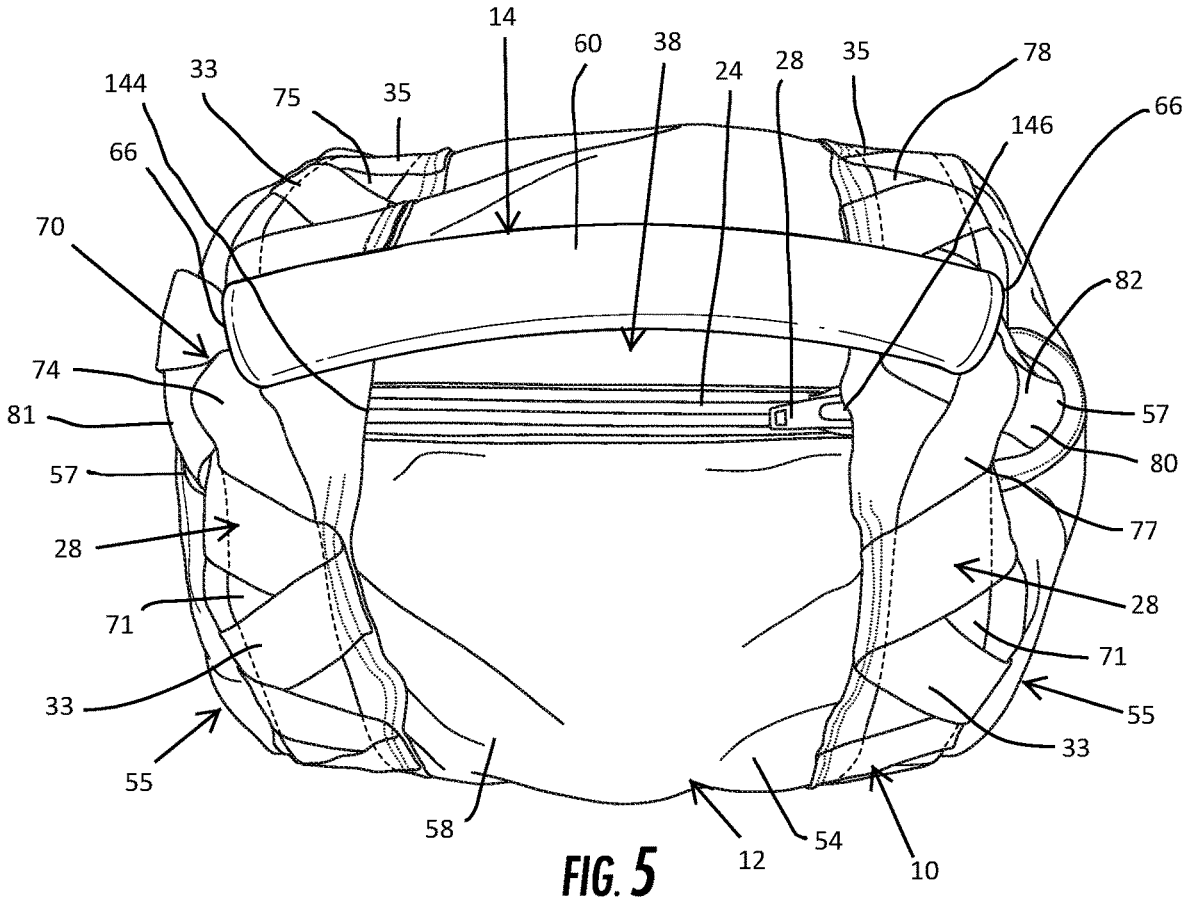
FIG. 5 is a bottom elevation view of the weighted bag of FIG. 1.
Figure 6:
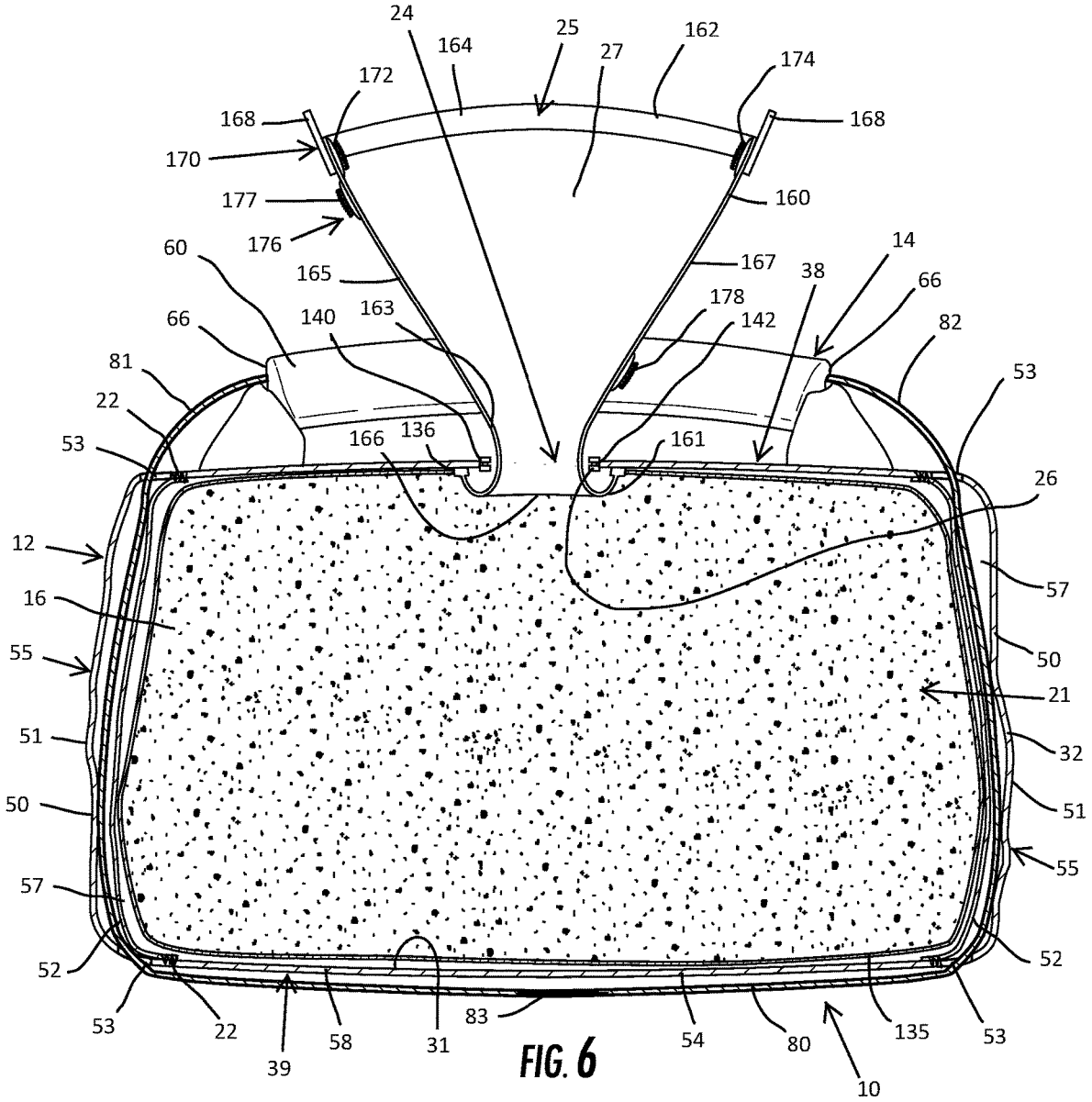
FIG. 6 is a cross-section view of the weighted bag of FIG. 1 taken along a central plane, with a filling mechanism in the form of a funnel extended from the weighted bag and a filling material filling the weighted bag.
Figure 7:
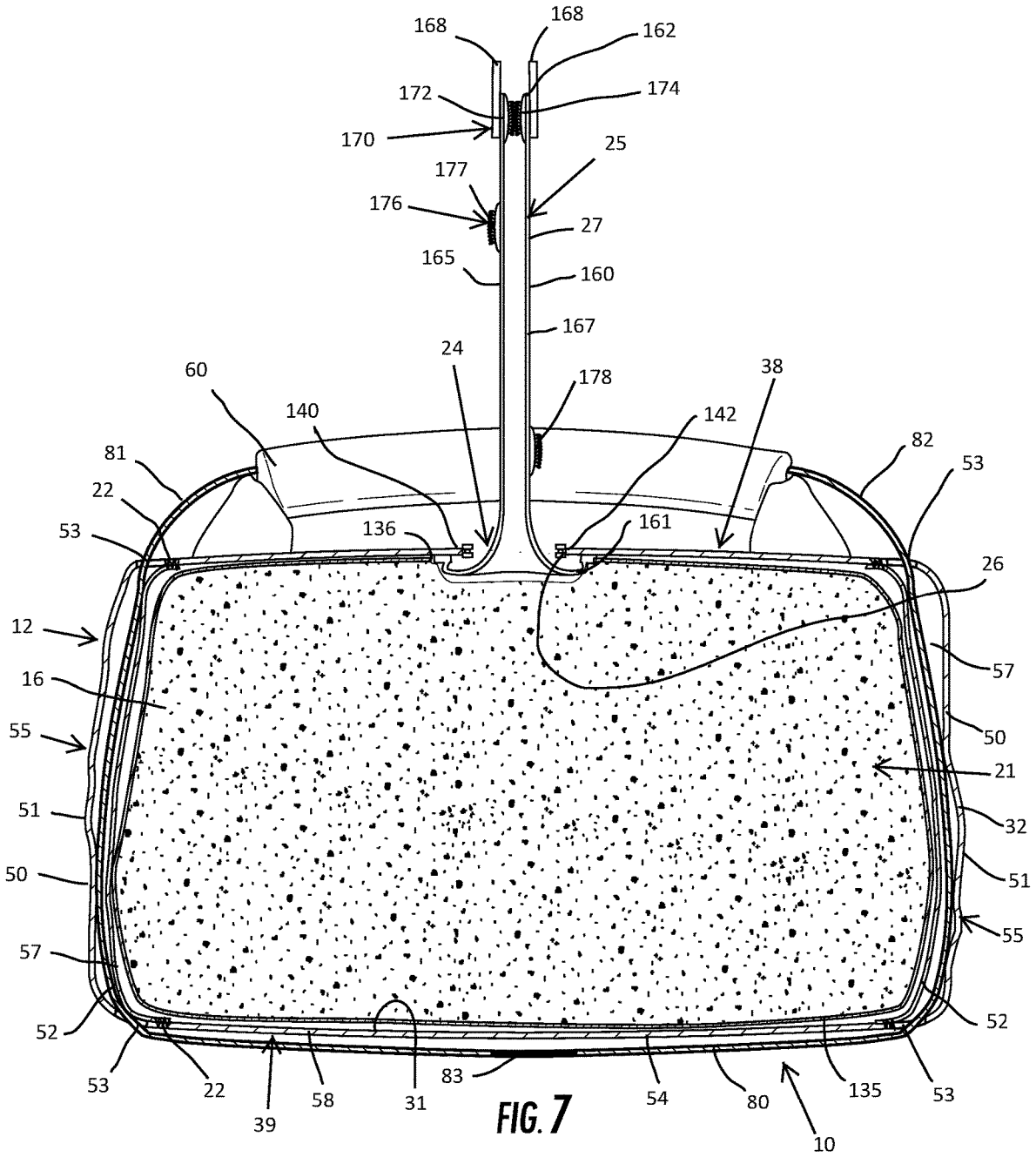
FIG. 7 is a cross-section view of the weighted bag of FIG. 6, with the funnel in a partially-collapsed configuration.
Figure 8:
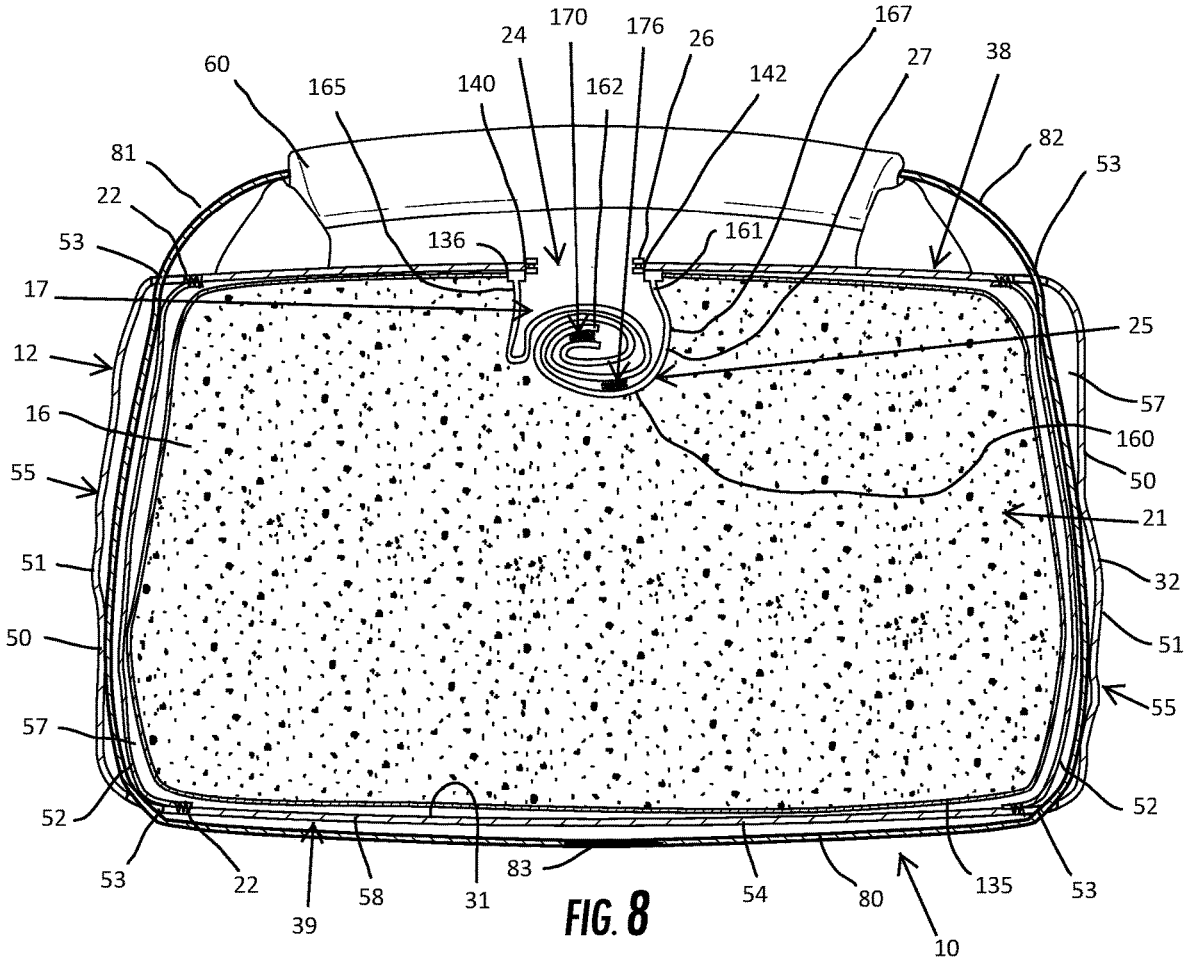
FIG. 8 is a cross-section view of the weighted bag of FIG. 6, with the funnel in a fully collapsed configuration.

With reference to the example embodiment of the outer shell 12 in FIGS. 1-8, the panels 20 include at least two opposed end panels 50 and central body panel 58. Each end panel 50 has an outer panel 51, an inner panel 52, and slot 57 defined between the inner and outer panels 51, 52. The outer panel 51 is coupled to the inner panel 52 by any number of different structures, but not limited to, cross-stitching, heat sealing, adhesive, among others. Each slot 57 in this embodiment, as shown in FIGS. 6-8, extends between the outer and inner panels 51, 52 and has upper and lower openings 53 to permit passage into and out of the slot 57, and the slot 57 extends continuously between the openings 53. In one embodiment, as shown in FIGS. 1-5, the outer and inner panels 51, 52 are connected together around the exteriors of the panels 51, 52, and in other embodiments, the panels 51, 52 may have inner walls, seams, adhesives, heat sealing, or other structures that define a slot 57 that is narrower than the widths of the panels 51, 52. In the embodiment of FIGS. 1-8, the end panels 50 are substantially parallel with each other, and the central body panel 58 extends between the end panels 50. The shell 12 in the embodiment of FIGS. 1-8 is entirely or substantially defined by the end panels 50 and the central body panel 58. In this embodiment, the shell 12 defines a cylindrical configuration, having a circular cylindrical portion or central body portion 54 formed by the central body panel 58 and circular flat or bulged ends 55 formed by the end panels 50. In other embodiments, the shell 12 may have a different shape, such as an oval cylinder, a cube, a rectangular cylinder, a triangular cylinder, etc. It is understood that the cylindrical portion 54 may simply be referred to as a "central body portion" when describing a shell 12 having a cylindrical shape or any other shape. Likewise, the relative sizes and shapes of the end panels 50 and the central body panel 58 may be different in other embodiments, and the cylindrical portion 54 and/or the ends 55 may be formed of a greater of smaller number of panels in other embodiments. In general, the cylindrical portion 54 and the ends 55 may each be formed by one or more panels 22.

In the embodiment of FIGS. 1-8, the bag 10 has an opening 24 and a filling mechanism 25 that is accessible through the opening 24 for filling the bag 10. The opening 24 in the embodiment of FIGS. 1-8 is placed along the central body panel 58 in such a manner that it allows entry to the inner cavity 21 of the bag 10. The opening 24 shown in FIGS. 1 and 5 is oriented along the length of central body panel 58 at the top of the bag 10, but the opening 24 may be oriented and/or located differently in other embodiments. The opening 24 includes a closure member 26 (also called a shell closure member) configured for releasably closing the opening 24. When engaged, the shell closure member 26 resists the movement of filler material 16 into or out of the opening 24. In the configuration shown, the opening 24 and the shell closure member 26 are positioned directly below the natural position of the handle 60, which can reduce the stresses that are placed in the region surrounding the opening.

As shown in FIGS. 1 and 5-8, the opening 24 is defined by first side edge 140, second side edge 142, first end 144, and second end 146 which collectively define the perimeter of the opening. The first side edge 140 and second side edge 142 are opposite and substantially parallel to each other and separated by the width of the opening 24. Further, the first end 144 and second end 146 are opposite to each other and separated by the length of the opening 24. The first side edge 140 and second side edge 142 are connected at their respective ends by first end 144 and second end 146. The first and second ends 144, 146 may be formed as V-shaped or U-shaped structures in one embodiment or may be straight linear sides that are substantially parallel to each other and perpendicular to the side edges 140, 142 in another embodiment. Generally, the opening 24 has an elongated rectangular configuration in the embodiment of FIGS. 1-8, and the opening 24 may have a differently-shaped configuration in other embodiments.

The shell closure member 26 is substantially planar to the opening 24 and coupled in such a way to edges of opening 24 that closure of the shell closure member 26 substantially closes the opening 24. The shell closure member 26, in the configuration of FIGS. 1-8, includes a zipper. In this configuration, the dimensions of the opening 24 are similar to the size of the shell closure member 26. In other words, the lengths of the edges of the shell closure member 26 are substantially parallel and comparable to the first side edge 140 and second side edge 142 of the opening 24. In contemplated configurations, the shell closure member 26 is secured in a manner that ensures close coupling along the entire edges 140, 142 of the opening 24. In other embodiments, the shell closure member 26 may have other configurations, such as a hook and loop fastener, snaps, buttons, flaps, and other fastening and/or closing structures or combinations of such structures may be utilized. It is understood that the configuration of the shell closure member 26 may depend at least partially on the configuration of the opening 24. For example, a shell closure member 26 in the form of a zipper may not be usable or optimal with some opening 24 configurations, and another type of closure member 26 may be used.

In the embodiment of FIGS. 1-8, the filling mechanism 25 includes a funnel structure 27 having a flexible encircling wall 160 forming a funnel shape, a grasping handle or grasping member 168, a filling mechanism closure member 170, and securing member 176. With particular reference to FIGS. 6-8, the flexible encircling wall 160 has a proximal end 161, a distal end 162, a lower exit 164, and an upper inlet 166. The proximal end 161 and distal end 162 are on opposite ends of the funnel 27, and the proximal end 161 is a fixed end connected to the shell 12, while the distal end 162 is a free end that can be extended out of the shell 12 through the opening 24 or retracted into the shell 12.

The proximal end 161 is connected to the inner surface 130 of the outer shell 12, as shown in FIGS. 6-8, and the connection between the proximal end 161 and the shell 12 forms a lower perimeter of the funnel 27. In the configuration of FIGS. 6-8, the proximal end 161 of the funnel 27 is secured to the inner surface of the shell 12 around the entire opening 24, along a connection line spaced from the opening 24. This configuration resists leakage of the filler material 16 through the connection between the proximal end 161 and the shell 12 and also provides a pocket 17 inside the opening 24 where the funnel 27 can be placed after collapsing, e.g., by folding or rolling, as described herein. The distal end 162, when fully extended and expanded, forms an upper perimeter of the funnel, and it is understood that the upper perimeter may be larger than the lower perimeter in one embodiment. Further, the funnel 27 may have a neck or narrowest portion 163 that is located between the proximal and distal ends 161, 162 and has a perimeter and a maximum width that are smaller than the perimeters and maximum widths at the proximal and distal ends 161, 162. In the embodiment shown in FIGS. 6-8, the neck 163 is located closer to the proximal end 161 than the distal end 162 and is configured to be generally located within the opening 24 when the funnel 27 is fully extended and expanded. It is to be understood the actual circumference or width at some locations are subject to change in shape, size and/or width during operation, articulation and folding of the funnel 27, and that the relative circumferences and widths described herein are the maximum such dimensions when the funnel 27 is fully extended and expanded. The wall 160 in FIGS. 6-8, including the lower exit 164 and the upper inlet 166, may be substantially oval or rectangular in shape in one embodiment, but these components are subject to variable changes in length and width in contemplated configurations and desired sizes of the weighted bag 10. It is to be understood the openings (exit 164 and inlet 166) are substantially large enough to allow entry of physical materials, such as sand or polymer beads, with minimal interference or resistance from the filling mechanisms 25.

The funnel 27 may have one or more grasping handles 168 at or near the distal end 162 to assist in pulling the funnel 27 through the opening 24 and/or opening the funnel closure 170 as described herein. The funnel 27 in FIGS. 6-8 has two grasping handles 168 on opposite sides of the inlet 166, with each grasping handle 168 in the form of a thin strap connected to the exterior of the wall 160 of the funnel 27. The grasping handles 168 are oriented to extend outwardly from the distal end 162 when the funnel 27 is in an open and extended position. Placement of the grasping handle 168 on the funnel is variable and subject to change in contemplated configurations of the funnel 27. The grasping handle 168 may be connected to the wall 160 by stitching, adhesive, or heat sealing, among other techniques, or a combination of such techniques.

The funnel 27 also has a funnel closure 170 configured to close the inlet 166 to resist egress of the particulate material 16. In the embodiment of FIGS. 6-8, the funnel closure 170 includes a first engaging portion 172 and second engaging portion 174 positioned on opposite sides 165, 167 of the wall 160 at the inlet 166 proximate the distal end 162 and configured to engage each other to releasably close the inlet 166. The first engaging portion 172 and second engaging portion 174 include elongated strips of complementary hook and loop materials that releasably connect to each other when engaged. The engaging portions 172, 174, when engaged, seal the sides 165, 167 to each other to close the upper inlet 166 and resist the entry or exit of material through the upper inlet 166. In the embodiment of FIGS. 6-8, the strips forming the first and second engaging portions 172, 174 extend equal distances along the entirety of both sides of the inlet 166 to completely close the inlet 166 when engaged. In other embodiments, other releasable connecting or fastening structures can be used as the funnel closure 170, such as snaps, buttons, zippers, and the like, as well as complementary structures when appropriate, or combinations of different structures.

The funnel 27 also includes a funnel securing structure 176 configured to secure and further resist ingress or egress of material through the funnel 27. The funnel securing structure 176 in FIGS. 6-8 includes a first securing member 177 and a second securing member 178 that are configured to engage each other to releasably close the inlet 166. The funnel securing structure 176 in FIGS. 6-8 is lower on the flexible encircling wall 160 than the funnel closure 170. The securing members 177, 178 in this embodiment are connected to the outer surface of the flexible encircling wall 160 on opposite sides 165, 167 of the wall 160 at different distances from the distal end 162. The first securing member 177 is connected to the first side 165 closer to the distal end 162, and the second securing member 178 is connected to the second side 167 farther from the distal end 162. In this configuration, the wall 160 is configured to be rolled or folded by rolling or folding the first side 165 over the second side 167 as shown in FIG. 8 to achieve engagement of the securing members 177, 178 to releasably retain the funnel 27 in the rolled or folded position. The securing members 177, 178 include elongated strips of complementary hook and loop materials that releasably connect to each other when engaged. The size and positioning of the securing members 177, 178 may be different in other embodiments. Additionally, the securing structure 176 may have a different configuration in other embodiments, such as any configuration of the funnel closure 170 discussed herein.

The inner cavity 21 of the outer shell 12 has filler material 16 within it when the device is prepared for use. Filler material 16 is designed to be a heavy but loose and flowable material including, but not limited to, sand, polymer beads, or other such particulate materials. In the embodiment of FIGS. 1-8, the bag 10 has an inner bag 135 connected around the opening 24 to contain the filler material 16, with seams (not shown) that define the shape of the inner bag 135 and/or connect pieces forming the inner bag 135. The inner bag 135 has an open end 136 that is connected to the shell 12 around the opening 24 such that the inner bag 135 is in communication with the exit 164 of the funnel 27. In this configuration, filler 16 fed into the inner cavity 21 through the filling mechanism 25 enters the inner bag 135 and is held by the inner bag 135. The inner bag 135 and the shell 12 may be designed differently in materials, connections (e.g., seams 22), and structure. For example, the materials, connections, and structure of the shell 12 may be configured for strength, durability, abrasion resistance, and comfort in handling, while the materials, connections, and structure of the inner bag 135 may be configured primarily for strength and resisting leakage.

The bag 10 can be filled by opening the shell closure member 26 to open the opening 24 and extending the filling mechanism 25 through the opening 24. The funnel 27 in FIGS. 6-8 can be fully extended by pulling the funnel 27 through the opening, disconnecting the securing structure 176, and then fully extending the funnel 27. When fully extended, the funnel 27 can be opened by disconnecting the closure 170 to open the inlet 166, which may be done with the assistance of the grasping handles 168. It is noted that the grasping handles may also be used to hold the upper inlet 166 open during filling. Once open, the filler material 16 can be filled into the cavity 21 (and the inner bag 135 if present) by entering through the upper inlet 166, travelling through the funnel 27, and exiting into the bag 10 through the lower exit 164.

After the desired amount of filler material 16 has been fed into the inner cavity 21 of the weighted bag 10, the closure 170 of the filling mechanism 25 is manipulated to close the inlet 166. In the embodiment of FIGS. 6-8, the first and second engaging portions 172, 174 are engaged with each other to close the inlet 166 of the funnel 27. The filling mechanism 25 can also then be collapsed into the opening 24, using the securing structure 176 to further secure the collapsed filling mechanism 25. In the embodiment of FIGS. 6-8, the funnel 27 is collapsed by rolling or folding the top of the flexible encircling wall 160 at such amounts and to such a degree to cause the securing members 177, 178 to engage with each other and secure the funnel 27 in a collapsed position. The filling mechanism 25 can then be pushed through opening 24 and into the cavity 21 of the shell 12, and the shell closure member 26 is then manipulated to close the opening 24. In this collapsed configuration, the funnel 27 is received within a pocket 17 defined below the opening 24 between the proximal end 161 of the funnel 27 and the inner surface 31 of the shell 12. The resultant configuration of the filling mechanism 25 is sealed against ingress and egress of material in multiple ways, including by the shell closure member 26, the filling mechanism closure 170, and the folding or rolling of the filling mechanism 25 (secured by the securing structure 176), which creates a tortuous path for the filling material 16 to escape.

The handle assembly 14 of the bag 10 in FIGS. 1-8 includes a handle 60 and a strap assembly 70 including one or more straps connecting the handle 60 to the shell 12 to permit the bag 10 to be lifted by grasping the handle 60. In one embodiment where the shell 12 has a cylindrical shape, such as shown in FIGS. 1-8, the strap assembly 70 includes at least one circumferential strap 71 that extends partially or completely around the circumference of the cylindrical portion 54 of the shell 12. The strap assembly 70 in FIGS. 1-8 includes first and second circumferential or peripheral straps 71 extending around at least a portion of the periphery of the shell 12, and a central or transverse strap 80 extending around at least a portion of the periphery of the shell 12 transverse to the circumferential straps 71. The circumferential straps 71 as shown in FIGS. 1-5 extend parallel to each other around the cylindrical portion 54 of the shell 12, with the two circumferential straps 71 each located proximate one of the ends 55, and the central strap 80 extends around the cylindrical portion 54 and the circular ends 55 of the shell 12 perpendicular or transverse to both circumferential straps 71. It is noted that the term "circumferential" is used herein with respect to a circular cylindrical structure as shown in FIGS. 1-8, but that the term "peripheral" may be used to describe these straps for use with a structure that is not necessarily circular. The terms "circumferential" and "peripheral" as used herein are not intended to imply that the relevant strap necessarily extends around the entire circumference or periphery of the bag 10, but only specify the direction in which the strap extends, i.e., around the circumference or periphery.

In the embodiment of FIGS. 1-5, the first and second circumferential straps 71 extend from opposite ends 66 of the handle 60 circumferentially around the periphery of the cylindrical portion 54, around the bottom 39 of the shell 12, and back toward the top 38 of the shell 12 to engage the handle 60. The first circumferential strap 71 in this embodiment includes a first strap portion 74 that engages the handle 60 at one end 66 and extends in a first circumferential direction around a portion of the cylindrical portion 54 of the shell 12 and a second strap portion 75 that engages the handle 60 at one end 66 and extends in a second, opposite circumferential direction around a portion of the cylindrical portion 54 of the shell 12. The strap portions 74, 75 of the first circumferential strap 71 are joined together at a joint 76 on the bottom 39 of the shell 12 to form a single strap 71. In other embodiments, the strap portions 74, 75 may be parts of a single, integral or continuous strap 71, or may not connect together, e.g., such as by connecting to the shell 12. The second circumferential strap 71 in FIGS. 1-5 is similarly configured, including a first strap portion 77 that engages the handle 60 at one end 66 and extends in a first circumferential direction around a portion of the cylindrical portion 54 of the shell 12 and a second strap portion 78 that engages the handle 60 at one end 66 and extends in a second, opposite circumferential direction around a portion of the cylindrical portion 54 of the shell 12. The strap portions 77, 78 of the second circumferential strap 71 are joined together at a joint 79 on the bottom 39 of the shell 12 to form a single strap 71. In other embodiments, the strap portions 77, 78 may be parts of a single, integral or continuous strap 71, or may not connect together, e.g., such as by connecting to the shell 12. The joints 76, 79 are formed by a combination of stitching and adhesives in one embodiment, but may be formed by additional connecting structures and techniques described herein, or combinations thereof.

In the embodiment of FIGS. 1-5, the first strap portions 74, 77 of the first and second circumferential straps 71 are formed as an integral or continuous strap 72 that extends from the joint 76 into and through the handle 60 and to the other joint 79, and the second strap portions 75, 78 of the first and second circumferential straps 71 are similarly formed as an integral or continuous strap 73. In this embodiment, the first and second circumferential straps are all formed as part of a continuous strap, connected by the joints 76, 79. It is understood that a "continuous" strap as used herein refers to a strap that functions or operates as a single piece (which may have joints or other junctures within), while an "integral" strap as used herein refers to a strap that is formed of a single, integral piece without joints, seams, etc. These straps 72, 73 each extend circumferentially around the same side of the cylindrical portion 54 proximate opposite ends 55 in this embodiment, but it is understood that in another embodiment the straps 72, 73 may cross each other within the handle 60 and extend on opposite sides. The strap portions 74, 75, 77, 78 in this embodiment engage the handle 60 at least by extending through the handle 60, and may be fixedly connected to the handle 60, or the handle 60 may be able to slide with respect to the strap portions 74, 75, 77, 78. In other embodiments, the strap portions 74, 75, 76, 77 may be separate pieces that are separately engaged with the handle 60, or each circumferential strap 71 may itself be formed as a single piece engaged with the handle 60. In a further embodiment, both of the circumferential straps 71 may be formed by a single-piece strap that extends twice through the handle 60 and around both ends of the cylindrical portion 54 of the shell 12. It is understood that the engagement between the strap portions 74, 75, 77, 78 and the handle 60 and the shell 12 is sufficient that the shell 12 can be lifted by exerting an upward force on the handle 60.

In the embodiment of FIGS. 1-5, the circumferential straps 71 are connected to or engaged with the shell 12 in a slidable configuration by retaining structures 28 in the form of loop assemblies or belt loop assemblies, rather than being fixedly connected to the shell 12. It is understood that the retaining structures 28 may be referred to as loop assemblies 28 in discussing the embodiment of FIGS. 1-5 herein, but that other retaining structures may be used to achieve similar functionality. In another embodiment, one or both of the circumferential straps 71 may be provided in the same or a similar configuration while being fixedly connected to the shell 12, such as by stitching, adhesive, heat sealing, etc. The loop assemblies 28 in FIGS. 1-5 are positioned around the cylindrical portion 54 of the shell 12 at or proximate to the opposed ends 55, and may be referred to as a first end loop assembly 28 and a second end loop assembly 28. In the embodiment of FIGS. 1-5, the first end loop assembly 28 secures the first circumferential strap 71 to the shell 12, and the second end loop assembly 28 secures the second circumferential strap 71 to the shell 12. The loop assemblies 28 in this configuration extend in both circumferential directions around the cylindrical portion 54 of the shell 12, from the top 38 to the bottom 39 of the shell 12.

The shell 12 in FIGS. 1-5 also has circumferential supports 30 that are fixedly connected to the shell 12 (e.g., to the central body panel 58) circumferentially around the cylindrical portion 54 proximate the ends 55 and extend beneath the loop assemblies 28. The circumferential supports 30 in the embodiment of FIGS. 1-5 are connected to the shell 12 around the entire circumference of the shell 12 and across the entire width of each support 30, except for the locations where the circumferential supports 30 cross the opening 24 and the closure 26, where the circumferential supports 30 are connected only around the outer edge (the junctures with the end panels 50). The circumferential supports 30 may be made from woven nylon or other durable fabric material and may be connected to the shell 12 by stitching and adhesives in one embodiment, but may be differently configured in other embodiments.

The loop assemblies 28 in the embodiment of FIGS. 1-5 each include a plurality of cross supports 33 that define a channel 35 beneath the cross supports 33, such that the cross supports 33 extend across the channel 35. The cross supports 33 in FIGS. 1-5 are arranged in an alternating or oscillating pattern, where each cross support 33 is oriented at an oblique angle to the circumferential direction, the longitudinal direction (i.e., between the ends 55), the channels 35, the circumferential straps 71, and the seams 22 around the end panels 50 (e.g., a "zig-zag" pattern). In this configuration, adjacent cross supports 33 have triangular gaps 37 between them to expose portions of the circumferential straps 71 beneath. In one configuration, the end of each cross support 33 overlaps with the end(s) of the adjacent cross support(s) 33 as shown in FIGS. 1-5, and these overlapping portions of the cross supports 33 are stitched together at the points of connection between the cross supports 33 and the shell 12. These points of connection may be formed by continuous circumferential seams 29 that are spaced from each other, parallel to each other, and located on opposite sides of the respective channel 35, as shown in FIGS. 1-5. In one embodiment, the cross supports 33 form angles of 55-60° or 50-65° with the edges of the circumferential supports and/or the circumferential direction, and adjacent cross supports 33 are oriented at angles of 60-70° with each other, although other angular orientations may be used in other embodiments.

Each channel 35 in the embodiment of FIGS. 1-5 is defined by a single strip of material that is folded over itself to form an overlapping, alternating pattern and stitched at and around the folds to the shell 12 to form the cross supports 33. In another embodiment, the cross supports 33 defining each channel 35 may be separate pieces that are connected together. The cross supports 33 in the embodiment of FIGS. 1-5 are connected directly to the circumferential supports 30, but this configuration may vary. In this configuration, the circumferential straps 71 are slidably restrained between the loop assemblies 28 and the circumferential supports 30, and the circumferential supports 30 provide strength, durability, and abrasion resistance at these areas. The channels 35 are defined between the undersides of the cross supports 33 and the confronting surface of the shell 12, which may include the circumferential supports 30 as in the embodiment of FIGS. 1-5, or the outer surface 32 of the shell 12 or other structures in other configurations. Additionally, in one embodiment, the cross supports 33 are connected to the circumferential supports 30, and both such structures are connected to the shell 12, by two parallel, spaced circumferential seams 29. In the embodiment of FIGS. 1-8, one of such circumferential seams 29 also forms the connection between the outer and inner end panels 51, 52 and the center body panel 58. In another embodiment, where a circumferential support 30 or other support layer is not present, the cross supports 33 may be directly connected to the shell 12 along such circumferential seams 29.

The channels 35 of each of the loop assemblies 28 in FIGS. 1-5 include an entrance region 34 at or near the top 38 of the bag 10, and an exit region 36 at or near the bottom 39 of the bag 10. In this configuration, the circumferential straps 71 extend through the channels 35, such that each of the strap portions 74, 75, 77, 78 extends into the entrance region 34 of one of the channels 35, through the respective channel 35, and out the exit region 36 of the channel 35. The joints 76, 79 of the circumferential straps 71 are located in the spaces between the exit regions 36 of the two channels 35 of the respective loop assembly 28. In another embodiment, the retaining structures 28 may not be in the form of loop assemblies with cross supports 33, and may instead use solid or porous panels to create the channels 35, similar to the slots 57, or may use a different structure for retaining the circumferential straps 71. It is understood that the retaining structures or loop assemblies 28 and associated structures such as the circumferential supports 30 are not illustrated in FIGS. 6-8 for simplification purposes.

The strapping assembly 70 also includes a central strap or transverse strap 80 that extends in a peripheral direction from the handle 60 around both ends 55 of the shell 12. The central strap 80 includes first and second central strap portions 81, 82 that are engaged with the handle 60 and extend from the ends 66 of the handle 60 around opposite ends 55 of the shell 12, and the strap portions 81, 82 of the central strap 80 are joined together at a joint 83 on the bottom 39 of the shell 12 to form a single strap 80. In the embodiment of FIGS. 1-8, the central strap 80 is formed as a single piece, extending through the handle 60 to form the strap portions 81, 82 on opposite sides of the handle 60 and having two ends that meet at the joint 83. In another embodiment, the central strap portions 81, 82 may be separate pieces that are separately engaged with the handle 60. The joint 83 is formed by a combination of stitching and adhesives in one embodiment, but may be formed by additional connecting structures and techniques described herein, or combinations thereof. In another embodiment, the central strap portions 81, 82 may not connect to each other, and may instead be connected to the shell 12 on the ends 55 or on the bottom 39. It is understood that the engagement between the strap portions 81, 82 and the handle 60 and the shell 12 is sufficient that the shell 12 can be lifted by exerting an upward force on the handle 60.

The portions 81, 82 of the central strap 80 in FIGS. 1-8 extend around the ends 55 of the shell 12 by extending through the slots 57 in the ends 55. As shown in FIGS. 6-8, the central strap portions 81, 82 extend between the outer and inner panels 51, 52 and through the upper and lower openings 53 to pass into and out of the slot 57. The central strap portions 81, 82 further extend beneath the circumferential straps 71 and across the bottom 39 of the shell 12 in this embodiment. The central strap 80 is slidably received within the slots 57 and is not fixedly connected to the shell 12 in the embodiment of FIGS. 1-8, but one or both of the central strap portions 81, 82 may be fixedly connected to the shell 12, e.g., within the slot 57 or on the bottom 39 of the shell 12. In another embodiment, the strap portions 81, 82 may extend around the ends 55 of the shell 12 by extending on the outsides of the outer panels 51. The inner panels 52 and/or the slots 57 may be absent, or the slots 57 may be created by an external structure, in such a configuration.

The strap assembly 70 in the embodiment of FIGS. 1-8 assists with distribution of forces around the shell 12, allowing the bag 10 to be handled roughly and even thrown into the air (e.g., 15 feet or more) and landing on the ground, while containing heavy filler material 16 (e.g., 50-100 pounds). The positions and orientations of the straps 71, 80 distribute the forces of lifting and throwing by the handle 60 evenly around the shell 12 and avoid concentration of stresses that can result at seams, bonds, or other fixed connections. Additionally, the ability of the straps 71, 80 to slide and move with respect to the shell 12 allows more even exertion of forces on the straps 71, 80 and allows each strap 71, 80 to compensate for forces exerted unevenly on other straps 71, 80. The configuration of the strap assembly 70 further improves durability of the straps 71, 80 themselves and of the bag 10 as a whole, among other benefits.

The handle 60 in the embodiment of FIGS. 1-8 is formed as an elongated tubular body 62 having a circular cross section and a central bore or passage 64 extending between opposing ends 66 along the direction of elongation. The body 62 is also slightly curved or arcuate in this configuration, rising in the middle with respect to the ends 66. In this embodiment, the handle 60 is oriented to extend longitudinally with respect to the shell 12, i.e., between the ends 55 and parallel to the central axis of the cylindrical portion 54. The outer surface of the body 62 of the handle 60 forms a grasping surface configured to be grasped by the user, and a coating, sleeve, or other structure applied to the body 62 to enhance gripping. The handle 60 may also have a coating, sleeve, or other structure applied to the inside of the central passage 64 to either increase or decrease grip or friction with respect to the straps 72, 73, 80 that extend through the central passage 64. In one embodiment, the handle 60 and/or the body 62 thereof may be made from a flexible and resilient material, such as a PVC hose material or the like. In the embodiment of FIGS. 1-8, the handle 60 is positioned above the outer shell 12 and the opening 24. In other embodiments, the handle 60 may have a different structure or material construction, including different shapes including, but are not limited to, ovals, squares, rectangles, or other shapes. In another embodiment, the handle 60 may not have a central passage 64, such as in an embodiment where the straps 72, 73, 80 are not continuous or where the handle 60 has other structures for engaging continuous straps 72, 73, 80. In a further embodiment, the handle 60 may have structures for fixedly connecting to the straps 71, 80.

One embodiment of a method for assembly of a weighted bag 10 as shown in FIGS. 1-8 may be performed using stitching, adhesives, heat sealing or pressing, or various other connection techniques to form seams and other connections between the various components. The loop assemblies 28 in this embodiment are constructed by folding four strips of material to form the cross supports 33 and fixedly connecting the cross supports 33 (e.g., by stitching, adhesives, heat sealing, etc.) along the edges of the circumferential supports 30 to create the alternating configuration of the cross supports 33. The cross supports 33 are not connected along the middle of the circumferential supports 30 to define the channels 35 between the cross supports 33 and the circumferential supports 30. The circumferential straps 71 and the central strap 80 are connected to the handle 60, which is accomplished in the embodiment of FIGS. 1-8 by pulling and/or pushing the single-piece straps 72, 73, 80 through the central passage 64 of the handle 60, such that the straps 72, 73, 80 extend from both ends 66 of the handle. The straps 72, 73, 80 may be connected together at one or more points within the handle 60 in one embodiment.

The funnel 27 is assembled by creating the encircling wall 160, e.g., from a single piece of fabric wrapped and connected to itself to form a funnel structure. The engaging portions 172, 174 and the securing members 177, 178 are connected to the wall 160 in appropriate locations, in the form of complementary strips of hook and loop material, in the embodiment of FIGS. 1-8. The grasping handles 168 may also be connected to the wall 160 at or proximate the inlet 166, and in one embodiment, the grasping handles 168 are connected prior to the engaging portions 172, 174 such that the engaging portions 172, 174 overlay the grasping portions 168.

The central body panel 58 is prepared by cutting the opening 24 through the central body panel 58 and the shell closure member 26 is connected to the opening 24. The shell closure member 26 may be provided with a shroud or other cover to protect the shell closure member 26 and increase comfort if the shell closure member 26 is contacted by the user during use, including a moveable cover or a static cover, e.g., to cover rigid surfaces such as zipper teeth. The circumferential supports 30 and the loop assemblies 28 are then positioned over and connected to the outer surface 32 of the central body panel 58 along opposite edges of the central body panel 58. The inner bag 135 is connected to the central body panel 58 by connecting the open end 136 around the opening 24 on the inner surface 31. The inner bag 135 may be formed before connecting to the central body panel 58, such as by connecting several panels of material together or using seams to form a single piece of material in the correct shape for the inner bag 135. The funnel 27 is also connected to the central body panel 58. by connecting the proximal end 161 of the wall 160 around the opening 24 on the inner surface 31. In one embodiment, the funnel 27 and the inner bag 135 may be connected together to the central body panel 58.

The shell 12 is then completed by connecting the end panels 50 to the central body panel 58 around the seams 22 shaped to form the cylindrical portion 54 with circular ends 55. In one embodiment, the inner panels 52 and the outer panels 51 are connected to the central body panel 58 with the same seam 22 or connection, and in another embodiment, the inner panels 52 are connected before the outer panels 51. The inner panels 52 are connected around their entire perimeters in this configuration, and the outer panels 51 are connected around the majority of the perimeters, but are not connected in strategic areas to form the slots 57. It is understand that a cover or lining may be applied around the openings 53 of each slot 57 for durability and abrasion resistance. The handle assembly 14 is then coupled to the shell 12 by extending the circumferential strap portions 74, 75, 77, 78 through the channels 35 and joining them at the joints 76, 79 to form the circumferential straps 71, and extending the central strap portions 81, 82 through the slots 57, and then joining them at the joint 83 to form the central strap 80. The bag 10 of FIGS. 1-8 is substantially complete after these steps have been accomplished.

Figure 9:
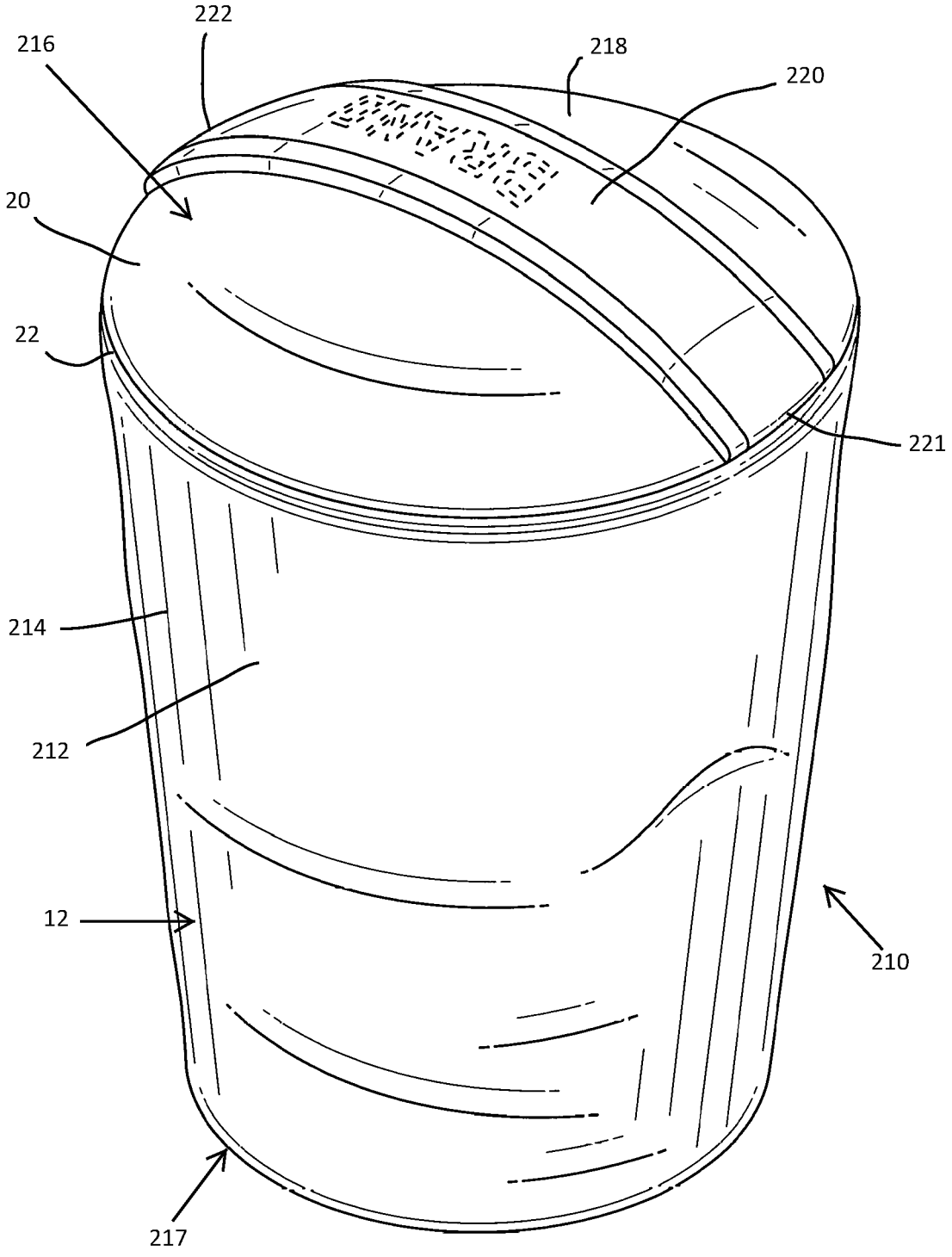
FIG. 9 is a front perspective view of another embodiment of a weighted bag according to aspects disclosed herein.
Figure 10:
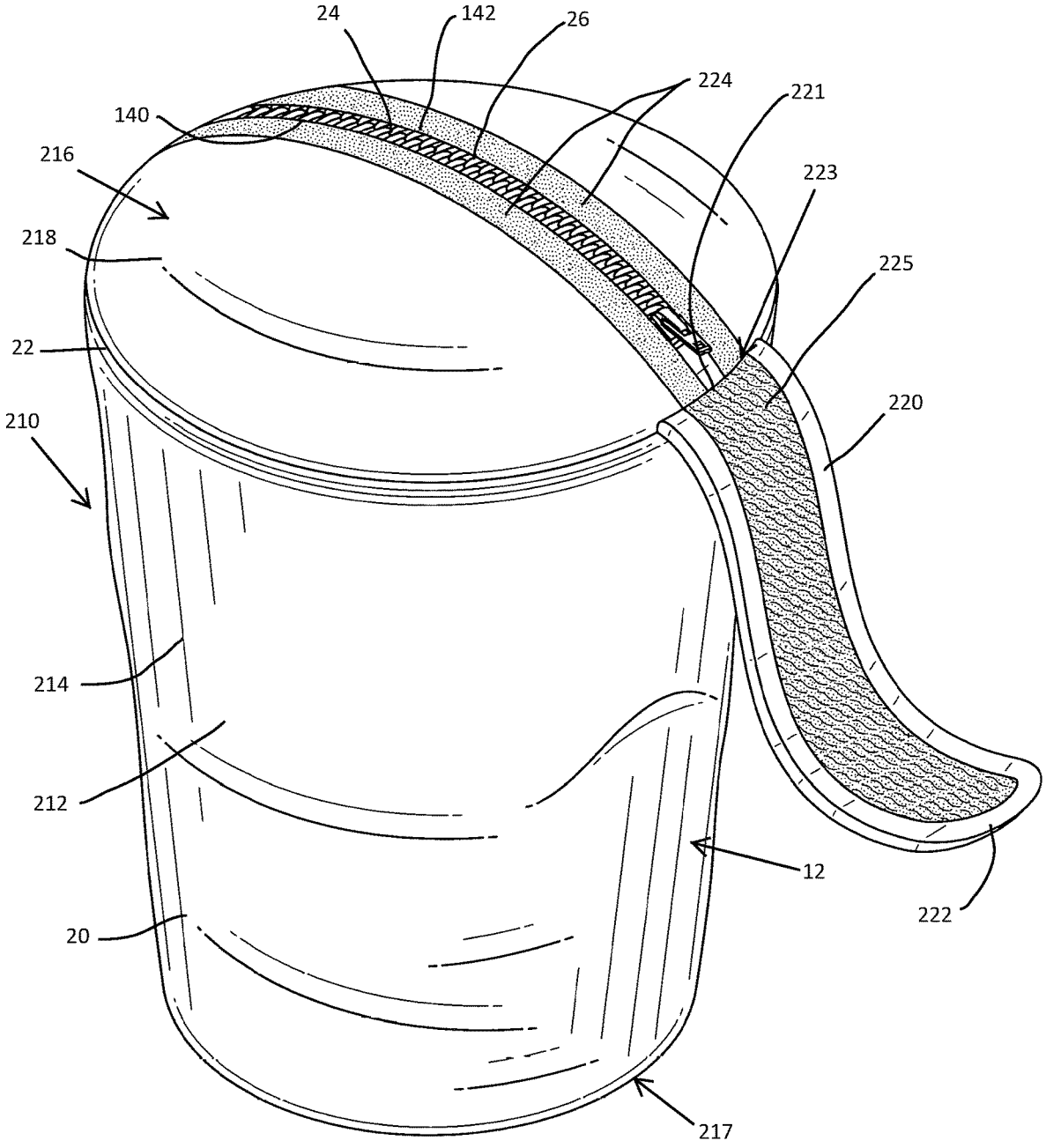
FIG. 10 is a front perspective view of the weighted bag of FIG. 9, with a releasable cover of the bag moved to expose an opening of the bag.
Figure 10A:
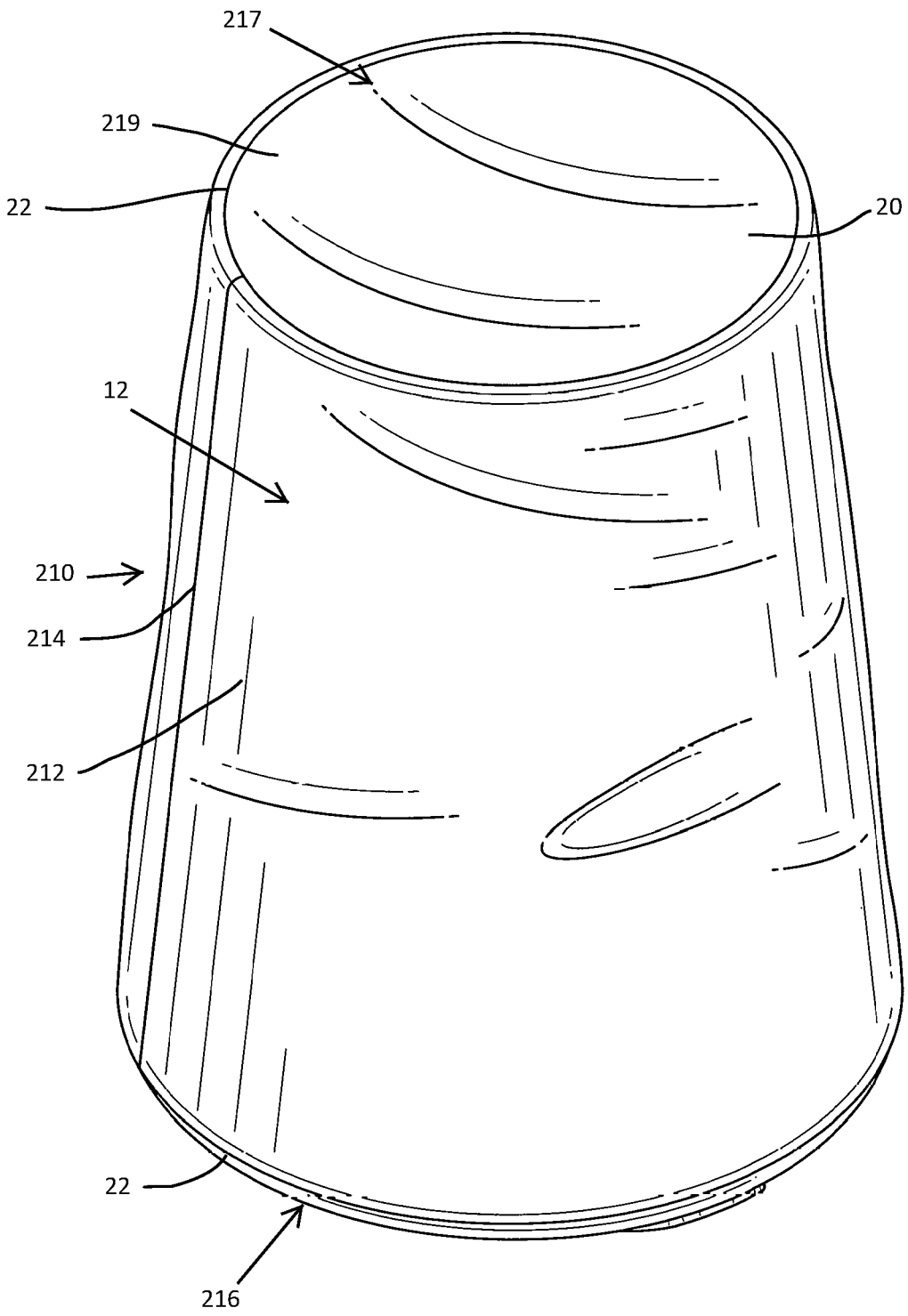
FIG. 10A is a bottom front perspective view of the weighted bag of FIG. 9.
Figure 11:
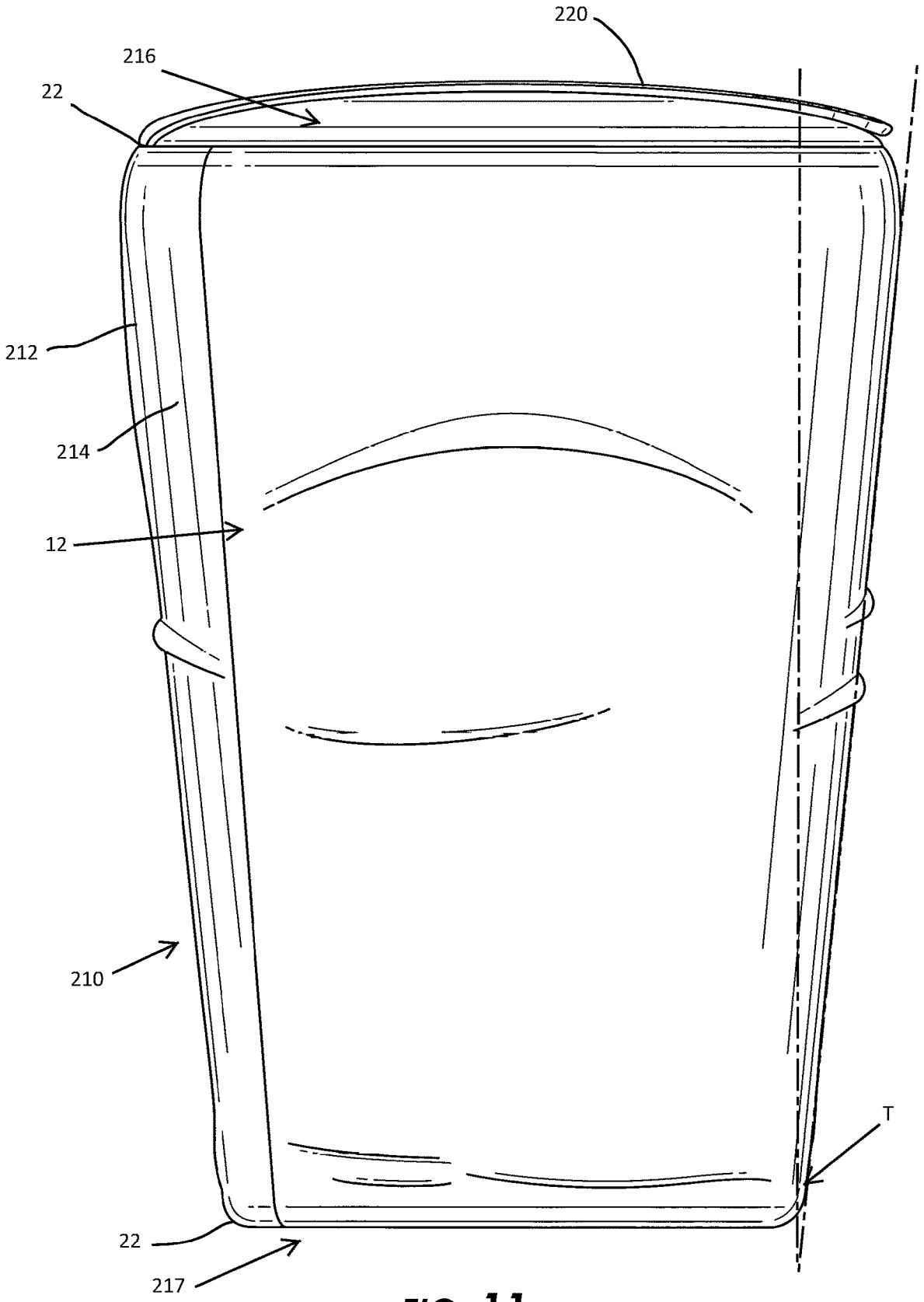
FIG. 11 is a front elevation view of the weighted bag of FIG. 9.
Figure 12:
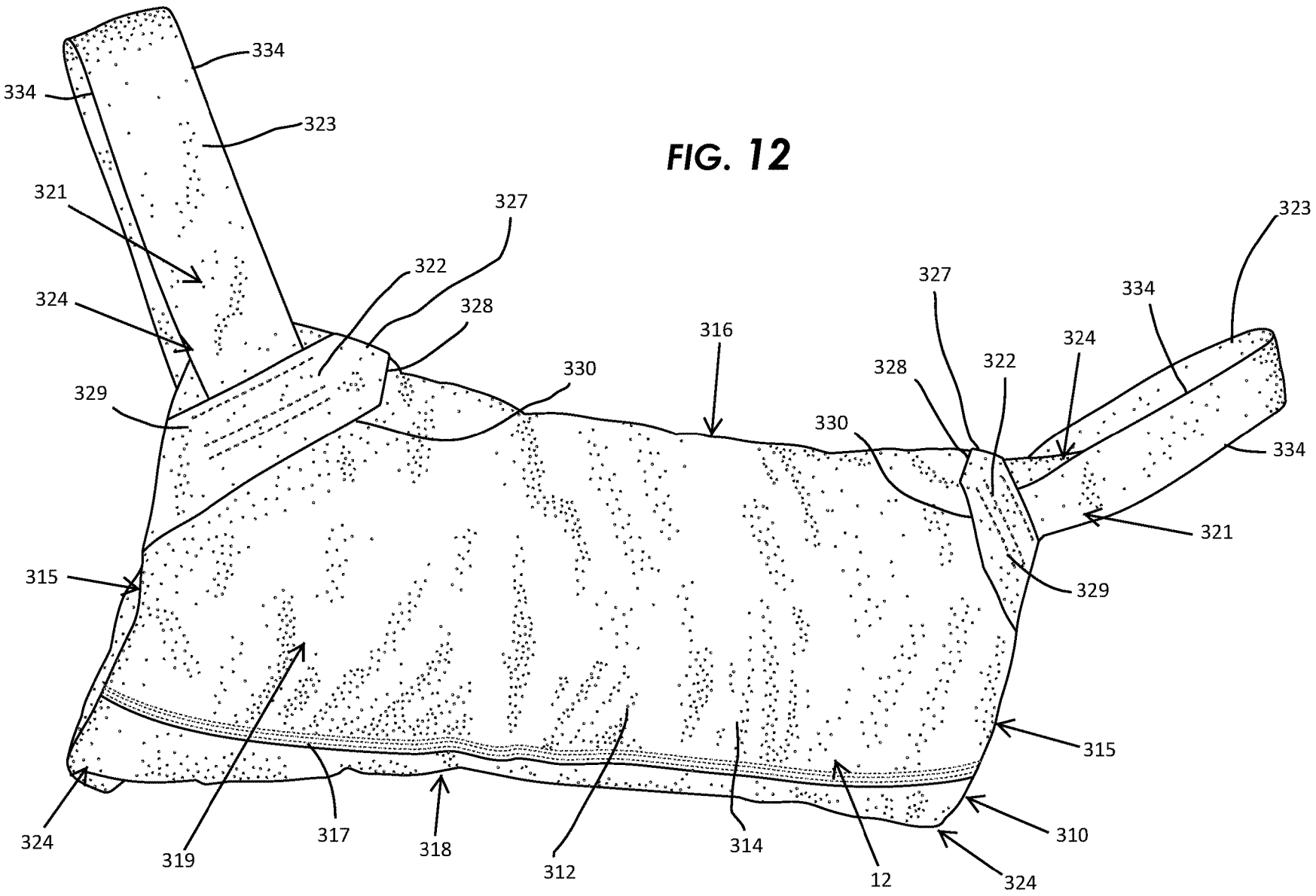
FIG. 12 is a rear perspective view of another embodiment of a weighted bag according to aspects disclosed herein.

FIGS. 9-11 illustrate another embodiment of a weighted bag 210 that includes many components and features in common with the bag 10 illustrated in FIGS. 1-8 and described herein. Such common features and components are referenced in FIGS. 9-11 with the same reference numbers used herein with respect to FIGS. 1-8, and such common features and components may not be re-described herein in detail with respect to the embodiment of FIGS. 9-11. While not illustrated in the drawings, the bag 210 of FIGS. 9-11 includes a filling mechanism 25 that is the same or similar to the filling mechanism 25 described herein and shown in FIGS. 6-8, in one embodiment. The filling mechanism 25 in this embodiment includes a funnel 27 having all the structural elements described herein with respect to the funnel 27 of FIGS. 6-8 and functioning in the same manner, but may include additional or alternate features as described herein in other embodiments. For example, the bag 210 in FIGS. 9-11 has a funnel 27 having a flexible encircling wall 160 with a proximal end 161 connected to the inner surface 31 of the shell 12 around the opening 24 and a distal end 162 that can be pulled through the opening 24 to extend the funnel 27 for filling. The wall 160 of the funnel 27 in this embodiment defines an inlet 166 proximate the distal end 162 and an exit 164 into the shell 12, and the funnel 27 also has a funnel closure 170 includes a first engaging portion 172 and second engaging portion 174 positioned on opposite sides 165, 167 of the wall 160 at the inlet 166 and securing members 176 as shown in FIGS. 6-8 and described herein. The bag 210 in FIGS. 9-11 also has an inner bag 135, as shown in FIGS. 6-8 and described herein, which is also not illustrated in FIGS. 9-11. It is understood that the inner bag 135 in the embodiment of FIGS. 9-11 is shaped to be consistent with the shape of the shell 12 of the bag 210.

The shell 12 of the bag 210 in FIGS. 9-11 has a frusto-conical or tapered shape, and may be formed by multiple panels 20 connected by seams 22 as described herein. In this embodiment, the shell 12 defines a tapered configuration, having a central body portion 212 formed by a central body panel 214 and circular flat or bulged ends 216, 217 formed by end panels 218, 219. The central body portion 212 in FIGS. 9-11 is formed as a tapered portion and has a frusto-conical shape that has a smaller width, perimeter (e.g., circumference), and cross-sectional area (relative to the central axis of the shell 12) at the bottom 38 and a larger width, perimeter, and cross-sectional area at the top 39, and the central body panel 214 is formed to create this shape. The central body portion 212 has a continuous linear taper between the ends 216, 217 when viewed from the side or in cross-section in the embodiment of FIGS. 9-11. The contour and taper of the central body portion 212 may be different in other embodiments, for example, a concavely curved taper creating a funnel shape, or a convexly curved taper, or a non-continuous linear taper. Additionally, in another embodiment, the central body portion 212 may not be tapered the entire distance between the ends 216, 217, i.e., the tapered portion may be a smaller portion of the central body portion 212. In such a configuration, the central body portion 212 may have a non-tapered portion or a reverse-tapered portion adjacent the tapered portion.

The ends 216, 217 of the shell 12 in the embodiment of FIGS. 9-11 are circular in shape, and the end panels 218, 219 forming the ends 216 are circular panels that may be bulged or flat. The top end 216 and the top end panel 218 have larger widths, perimeters (e.g., circumferences) and surface areas than the bottom end 217 and the bottom end panel 219, which complements the taper of the central body portion 212. In one embodiment, the top end 216 may have a width of 12-20 in., or 14-18 in., the bottom end 217 may have a width of 6-14 in., or 8-12 in., and the height of the central body portion 212 may be 19-25 in., or 20-24.5 in. In another embodiment, the bag 210 may be larger or smaller, but the ends 216, 217 may have similar proportions, i.e., the ratio of the width of the top end 216 to the width of the bottom end 217 is 1.25:1-2:1 or 1.5:1-1.75:1. In such embodiments, the ratio of the area of the top end 216 to the area of the bottom end 217 is 1.5:1-4:1 or 2.25:1-3:1 In a shell 12 where the central body portion 212 has a continuous linear taper, the taper angle T of the central body portion 212 in such a configuration is 6-10°, or 7-9°, with respect to the vertical direction and/or central axis of the shell 12. It is understood that the central axis is an axis that passes through the center of volume of the shell 12 when fully expanded and passes through the geometric center of the top and bottom ends 216, 217, which may be an axis of symmetry in a symmetrical structure. The bag 210 in FIGS. 9-11 is configured for lifting by the user holding the bag 210 against his/her chest and wrapping his/her arms around the central body portion 212, and the tapering of the central body portion 212 produces a shape that is advantageous for such usage, by aiding the user in holding the bag 210 without downward slippage due to the weight of the bag 210.

The bag 210 has an opening 24 on the top 38 of the shell 12, which is formed by an opening along the centerline of the top end panel 218 in the embodiment of FIGS. 9-11. The opening 24 is provided with a closure mechanism 26 in the form of a zipper in this embodiment. It is understood that the opening 24 and the closure mechanism 26 may have any structure discussed herein with respect to the opening 24 and the closure mechanism 26 of FIGS. 1-8. The opening 24 and the closure mechanism 26 in this embodiment function in the same way as in the bag 10 of FIGS. 1-8, whereby the closure mechanism 26 opens to allow the funnel 27 to be extended for filling the bag 210, and the closure mechanism 26 can be closed after collapsing the funnel 27 to seal the opening 24. The closure mechanism 26 in FIGS. 9-11 has a moveable cover 220 that can be moved to cover the opening 24 as shown in FIG. 9, or to uncover the opening 24 as shown in FIG. 10. The cover 220 in FIGS. 9-11 is in the form of a flap that is anchored at a proximal end 221 and has a free distal end 222 that can be folded to cover or uncover the opening 24 as desired. Additionally, the bag 210 in this embodiment has a releasable connecting structure 223 configured for retaining the cover 220 to the top 38 of the shell 12 to cover the opening 24, including complementary engaging members 224, 225 in the form of strips of hook and loop material. The releasable connecting structure 223 illustrated in FIG. 10 includes engaging members 224 in the form of two strips of hook and loop material connected to the top end panel 218 along opposite sides of the opening 24 and another one or more engaging members 225 in the form of a complementary strip of hook and loop material connected to the underside of the cover 220.

The bag 210 may be made using the same materials and techniques described herein with respect to the embodiment of FIGS. 1-8. In particular, the shell 12, the inner bag 135, and the filling mechanism 25 can be assembled in a similar manner as the same components in FIGS. 1-8. Assembly of the bag 210 in FIGS. 9-11 further includes connecting the engaging members 224 to the top end panel 218 around the opening 24 and connecting the engaging member 225 to the underside of the cover 220, and then connecting the cover 220 to the shell 12, using any of the connection structures and techniques described herein, including stitching, adhesives, and heat sealing, among others.

FIGS. 12-18 illustrate another embodiment of a weighted bag 310 that includes many components and features in common with the bag 10 illustrated in FIGS. 1-8 and the bag 210 illustrated in FIGS. 9-11 and described herein. Such common features and components are referenced in FIGS. 12-18 with the same reference numbers used herein with respect to FIGS. 1-11, and such common features and components may not be re-described herein in detail with respect to the embodiment of FIGS. 12-18. While not illustrated in the drawings, the bag 310 of FIGS. 12-18 includes a filling mechanism 25 that is the same or similar to the filling mechanism 25 described herein and shown in FIGS. 6-8, in one embodiment. The filling mechanism 25 in this embodiment includes a funnel 27 having all the structural elements described herein with respect to the funnel 27 of FIGS. 6-8 and functioning in the same manner, but may include additional or alternate features as described herein in other embodiments. For example, the bag 310 in FIGS. 12-18 has a funnel 27 having a flexible encircling wall 160 with a proximal end 161 connected to the inner surface 31 of the shell 12 around the opening 24 and a distal end 162 that can be pulled through the opening 24 to extend the funnel 27 for filling. The wall 160 of the funnel 27 in this embodiment defines an inlet 166 proximate the distal end 162 and an exit 164 into the shell 12, and the funnel 27 also has a funnel closure 170 includes a first engaging portion 172 and second engaging portion 174 positioned on opposite sides 165, 167 of the wall 160 at the inlet 166 and securing members 176 as shown in FIGS. 6-8 and described herein. The bag 310 in FIGS. 12-18 also has an inner bag 135, as shown in FIGS. 6-8 and described herein, which is also not illustrated in FIGS. 12-18. It is understood that the inner bag 135 in the embodiment of FIGS. 12-18 is shaped to be consistent with the shape of the shell 12 of the bag 210.

The shell 12 of the bag 310 in FIGS. 12-18 has a rectangular shape from the front and the rear and an oval shape (when filled) from the sides. In this embodiment, the shell 12 defines a rectangular configuration that is elongated between two opposed ends 315. The shell 12 has a central body portion 312 formed by a single panel 314 that is wrapped around a top 316 and a bottom 318 of the central body portion 312 and is connected to itself along end seams 313 at opposed ends 315 and along a lateral seam 317 extending between the ends 315 on the rear side 319 of the shell 12. The rear seam 317 extends across the rear side parallel to the lateral centerline L of the shell 12 (see FIG. 13) and below the lateral centerline L, i.e., between the lateral centerline L and the bottom 318. The shell 12 of the bag 310 in FIGS. 12-18 is elongated between the ends 315 to form the rectangular shape having four corners 324. When the bag 310 is filled with the filling material 16, the corners 324 retain semi-pointed shapes, while the top 316 and bottom 318 become rounded to create the oval shape of the filled shell 12. In this configuration, the top 316 and bottom 318 may develop a slight outward curvature toward the corners 324 and a more flattened shape near the lateral centerline of the bag 310. The shell 12 may have a different shape in other embodiments, and/or the shell 12 may be made from multiple panels in other embodiments.

Figure 13:
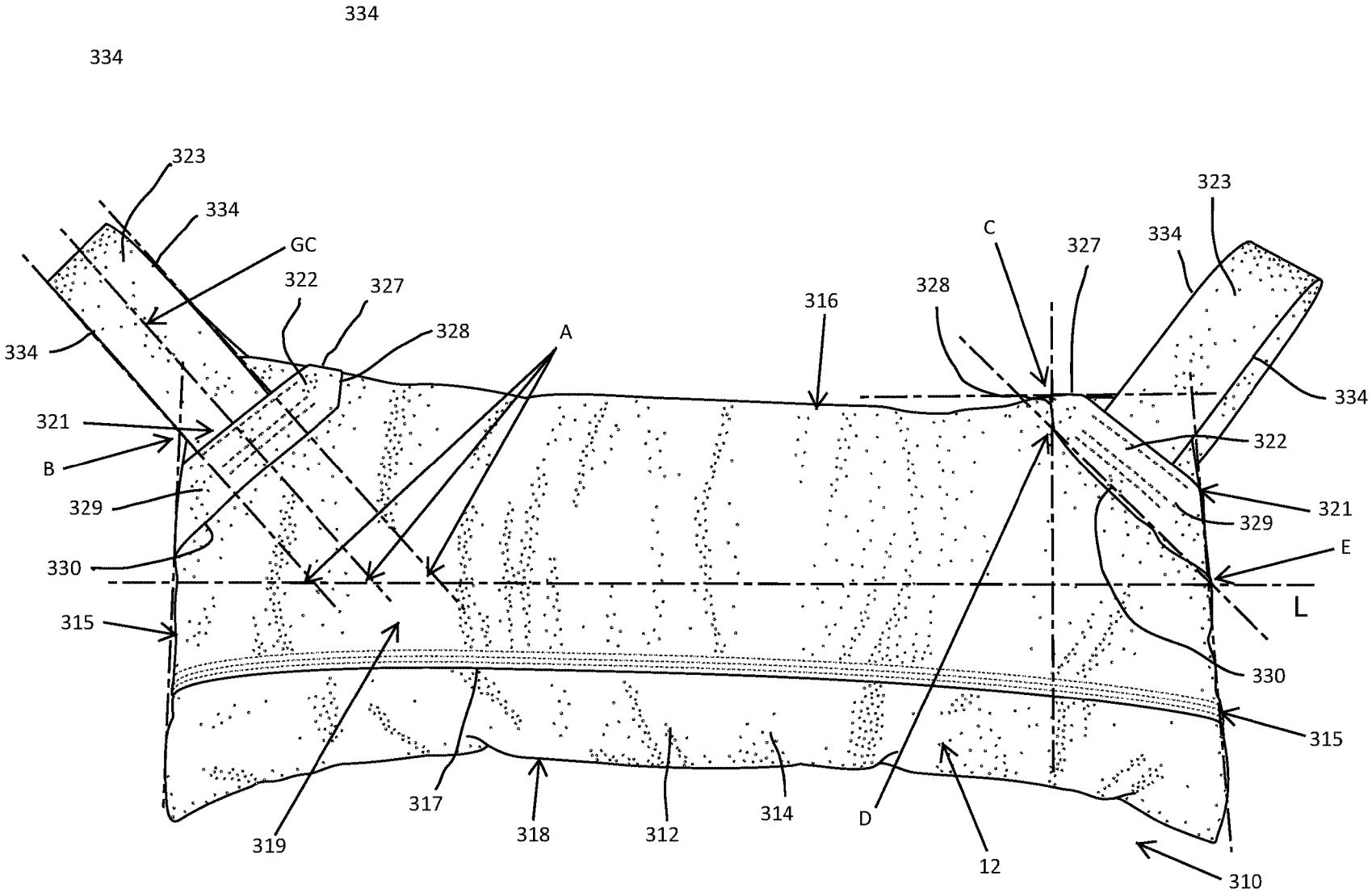
FIG. 13 is a rear elevation view of the weighted bag of FIG. 12.
Figure 14:
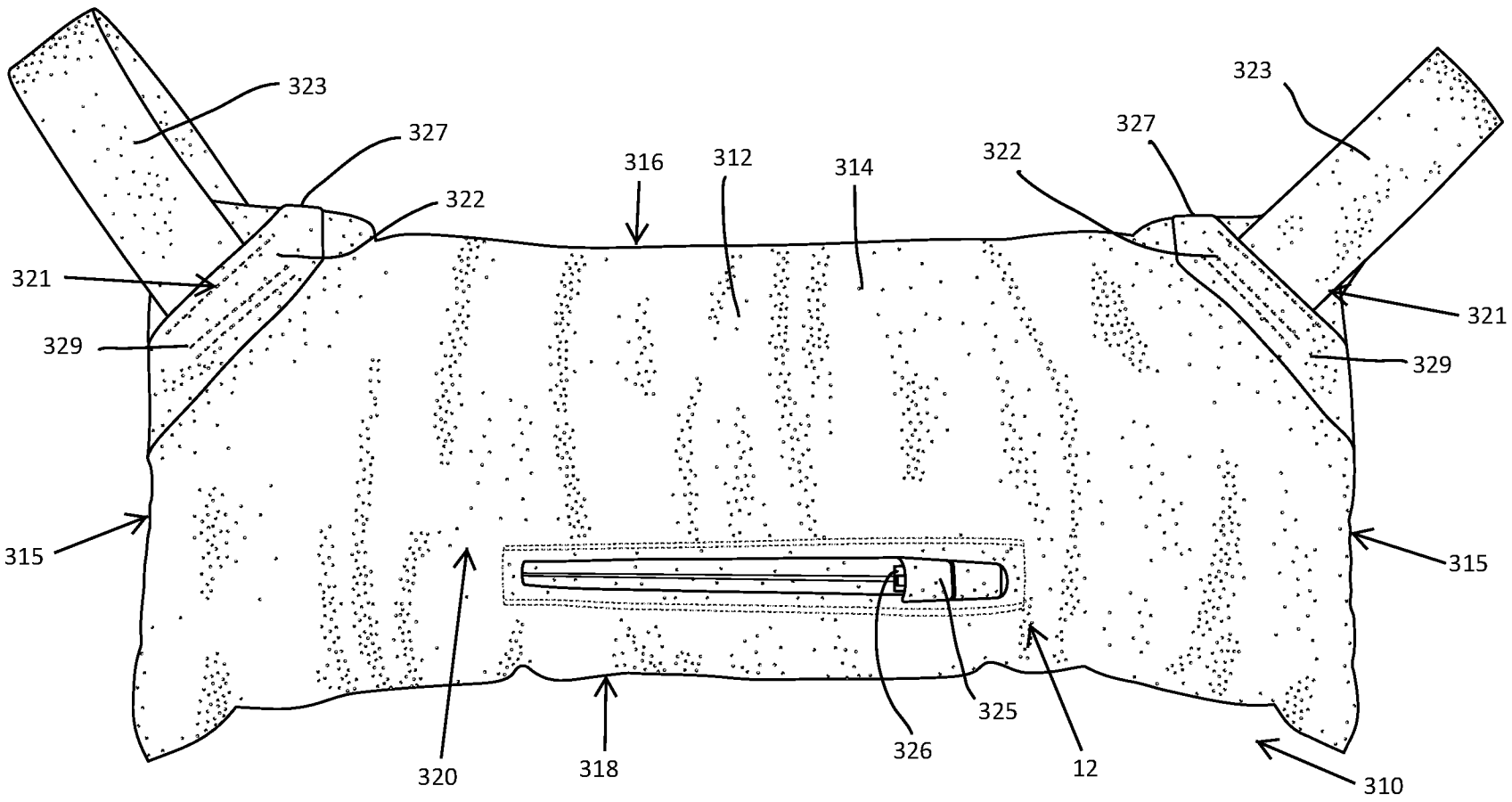
FIG. 14 is a front elevation view of the weighted bag of FIG. 12.
Figure 16:
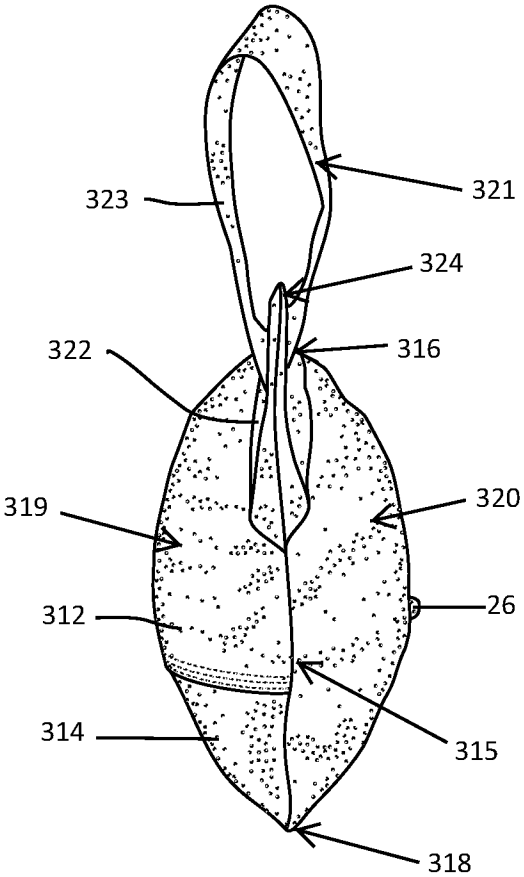
FIG. 16 is a left side elevation view of the weighted bag of FIG. 12.
Figure 15:
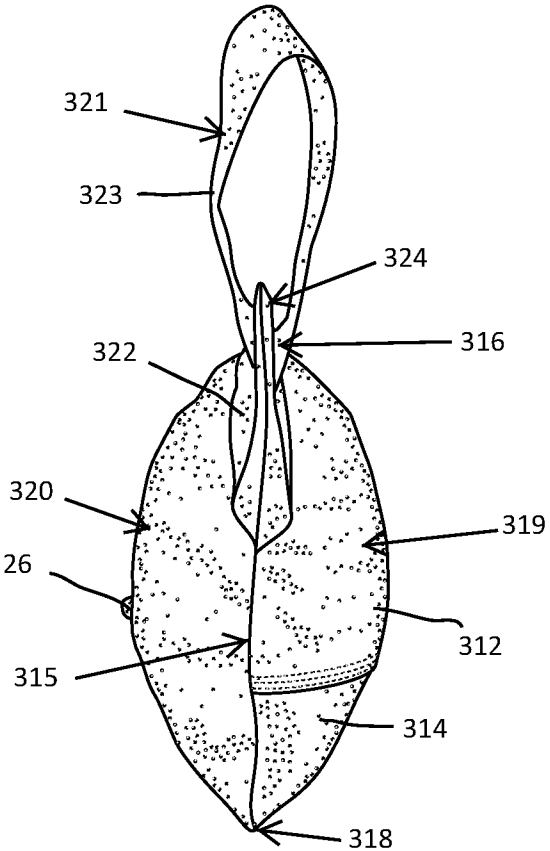
FIG. 15 is a right side elevation view of the weighted bag of FIG. 12.

The bag 310 has an opening 24 on the front 320 of the shell 12, which is formed by an opening through the panel 314 along the centerline of the front 320 in the embodiment of FIGS. 12-18. The opening 24 is provided with a closure mechanism 26 in the form of a zipper in this embodiment. It is understood that the opening 24 and the closure mechanism 26 may have any structure discussed herein with respect to the opening 24 and the closure mechanism 26 of FIGS. 1-8. The opening 24 and the closure mechanism 26 in this embodiment function in the same way as in the bag 10 of FIGS. 1-8, whereby the closure mechanism 26 opens to allow the funnel 27 to be extended for filling the bag 310, and the closure mechanism 26 can be closed after collapsing the funnel 27 to seal the opening 24. The closure mechanism 26 in FIGS. 12-18 has a fixed cover 325 that covers one end of the opening 24 as shown in FIG. 14. The cover 325 is positioned so that the handle 326 of the zipper of the closure mechanism 26 can be positioned beneath the cover 325 when the closure mechanism 26 is in the closed position, in order to avoid the zipper handle 326 from pressing into the user's skin during use, enhancing comfort. The cover 325 in FIG. 14 is in the form of an arch that is anchored at the ends and arches over the end of the opening 24.

In one embodiment, the bag 310 has two handles 321 connected to the shell 12 near the junctures between the top 316 and the ends 315, i.e., the corners 324 along the top 316 of the shell 12 in the rectangular shell 12 shown in FIGS. 12-18. The handles 321 in this embodiment each include a base 322 fixedly connected to the shell 12 and a gripping member 323 extending outward from the base 322. The gripping members 323 are each formed as a loop for the user's hand to extend through in the embodiment of FIGS. 12-18. In this embodiment, each of the gripping members 323 has ends that are connected to the front and rear sides 320, 319 of the shell 12 with the gripping member 323 forming a loop configuration between these connections. In other embodiments, the gripping members 323 may be connected only to the front or rear side 320, 319 of the shell 12 and still have a loop configuration, or the gripping members 323 may have a different configuration (e.g., a tethered handle). Additionally, the gripping members 323 in one embodiment extend outward at oblique angles A with the lateral centerline L of the shell 12 (see FIG. 13) and oblique angles B with the nearest peripheral edges of the shell 12. In one embodiment, the angles A are approximately 45° (40-50°) to the lateral centerline L, and the angles B are approximately 135° (125-145°) with the nearest peripheral edge, i.e., the top 316 or the nearest end 315 of the shell 12 in this embodiment. The angles B are measured with respect to the edges 334 of the gripping members 323 that are nearest the respective peripheral edge of the shell 12. In other embodiments, the gripping members 323 may extend outward at angles A that are 30-60° to the lateral centerline L of the shell 12), and the edges 334 of the gripping members 323 form angles B of approximately 120-150° with the nearest peripheral edge, i.e., the top 316 or the nearest end 315 of the shell 12 in such embodiments. It is understood that the angles A and B described herein are measured with respect to the gripping members 323 when extended to their furthest degree of extension in their most natural direction of extension, as shown in FIG. 13. It is also understood that the angle A measured with respect to the lateral centerline L can be measured with respect to either edge 334 or the geometric centerline GC of the gripping member 323 in an embodiment as in FIG. 13 where the edges 334 and the geometric centerline GC are all parallel to each other, although in some less symmetrical configurations, the geometric centerline GC may be a more appropriate. In other words, the angle A can be measured with respect to at least one of the edges and/or the geometric centerline. It is further understood that the angles A and B are measured when the bag 310 is empty and pressed flat to the ground.

The bases 322 of the handles 321 are connected to the shell 12 proximate the top corners 324, and the bases 322 in FIGS. 12-18 extend on both the front side 320 and the rear side 319 of the shell 12 to permit the gripping members 323 to connect to both sides 319, 320. In the embodiment of FIGS. 12-18, each base 322 is formed of a single strip of material that extends from the nearest end 315 at an angle across the front 320 of the shell 12, over the top 316 of the shell 12, and then at an angle across the rear 319 of the shell 12 back to the end 315. In this configuration, the base 322 is not connected to the corner 324, leaving the corner 324 exposed. The base 322 in this configuration has a crossing portion 327 that extends over the top 316 of the shell 12, and the inner edge 328 of the crossing portion 327 (i.e., farthest edge inward from the nearest end 315) in FIGS. 12-18 extends approximately perpendicular (90°) to the top 316 of the shell 12 when the bag 310 is empty and pressed to the ground. In other words, the angle C between the inner edge 328 of the crossing portion 327 and the top 316 of the shell 12 is 80-100° or 85-95°. The inner edge 328 of the crossing portion 327 may additionally or alternately form the same or similar angles with respect to the lateral centerline L of the shell 12 and/or a line (not shown) extending directly between the top corners 324 on the shell 12. This configuration is shown in greater detail in FIGS. 17-18. The inner edge 328 of the crossing portion 327 is a straight edge in the embodiment of FIGS. 12-18, i.e., the inner edge 328 would be straight and linear if the base 322 were laid flat. Additionally, the base 322 in FIGS. 12-18 has angling portions 329 that angle across the front and rear sides 320, 319 of the shell and juncture with the crossing portion 327, and the inner edge 330 of each angling portion 329 forms a juncture angle D with the crossing portion 327 that is 110-140° or 120-130°. The angle Eat the juncture between the inner edge 330 of each angling portion 329 and the nearest end 315 of the shell 12 is 40-70° or 50-60°. It is understood that the angles C, D, and E are measured when the bag 310 is empty and pressed flat to the ground. The crossing portion 327 in the embodiment of FIGS. 12-18 has a narrower width measured between the inner edge 328 and the opposite (outer) edge that is smaller than the widths of the angling portions 329.

Figure 17:
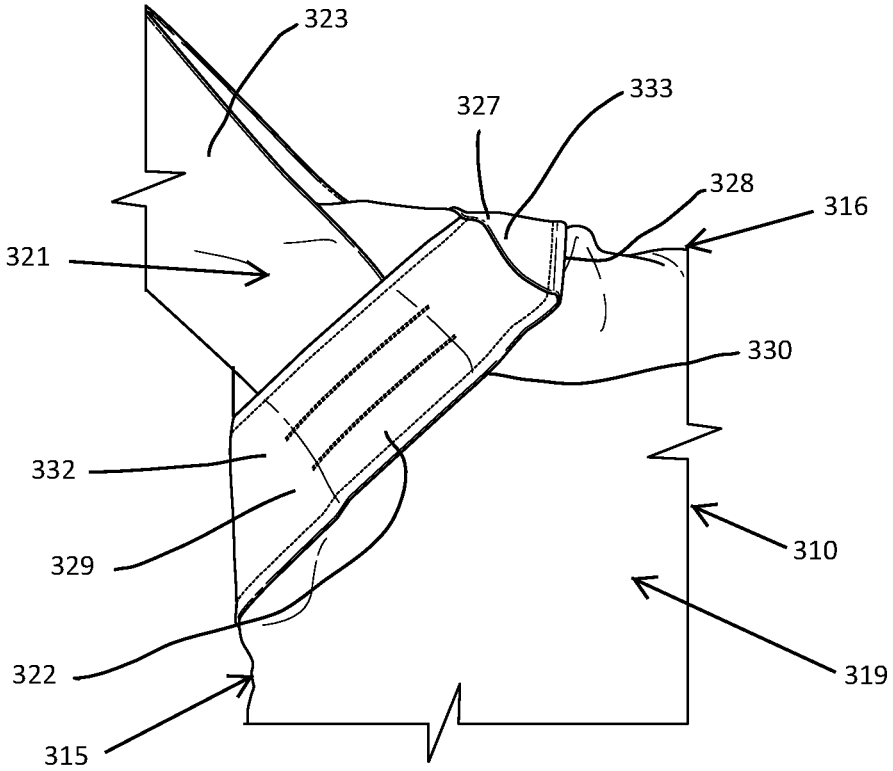
FIG. 17 is a magnified view of a portion of the weighted bag of FIG. 13.
Figure 18:
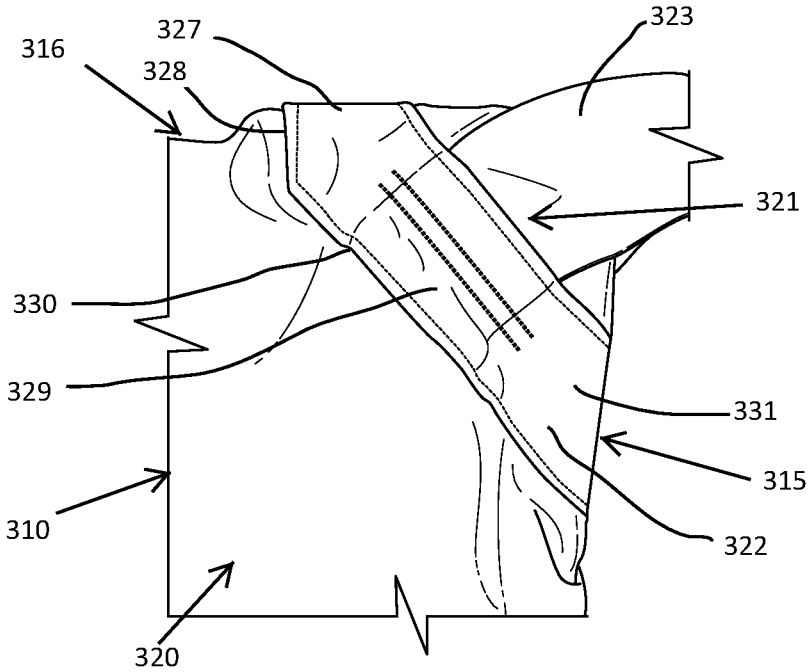
FIG. 18 is a magnified view of a portion of the weighted bag of FIG. 14.

The narrower width and the angles C and D in the embodiment of FIGS. 12-18 are created by folding the base 322 over itself toward the nearest end 315 of the shell 12 and connecting the folded portion 333 to the base 322, as shown in FIG. 17. Each base 322 may be formed of an integral or continuous panel or strap having first and second opposed surfaces 331, 332, in one embodiment. In this configuration, the first surface 331 forms the outer surface of the angling portion 329 on the front side 320 of the shell 12 and the inner surface of the angling portion 329 (contacting the shell 12) on the rear side 319 of the shell 12, and the second surface 332 forms the outer surface of the angling portion 329 on the rear side 319 of the shell 12 and the inner surface of the angling portion 329 (contacting the shell 12) on the front side 320 of the shell 12.

The angles A-E described herein provide a more ergonomic and athletically efficient form for the bag, which is designed to be picked up by a user and thrown over his/her back for carrying so that the top 316 rests on the user's neck and shoulders. The angles A-B of the gripping members 323 provide effective and comfortable angles for lifting and carrying, and the angles C-E of the base 322 provide durability and advantageous distribution of forces and stresses on the shell 12 during lifting and carrying. As one particular example, the angle C between the inner edge 328 of the crossing portion 327 and the top 316 of the shell 12 avoids excessive concentration of stresses at the juncture between the base 322 and the top 316 of the shell 12, which can result in separation of the base 322 from the shell 12 and/or ripping of the shell 12 at that location. It is also noted that the position of the rear seam 317 below the lateral centerline L of the shell 12 avoids stress concentrations at the seam 317 by distancing the seam 317 from the handles 321 and also reduces the chance that the user will carry the bag 310 with the seam 317 in contact with his/her neck or shoulders, which could reduce comfort.

The bag 310 may be made using the same materials and techniques described herein with respect to the embodiment of FIGS. 1-8. In particular, the shell 12, the inner bag 135, and the filling mechanism 25 can be assembled in a similar manner as the same components in FIGS. 1-8. Assembly of the bag 310 in FIGS. 12-18 further includes connecting the gripping members 323 to the bases 322 of the handles 321, and then connecting the handles 321 to the top side 316 of the shell 12, using any of the connection structures and techniques described herein, including stitching, adhesives, and heat sealing, among others.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative and relative purposes only and do not limit the embodiments in any way. Nothing in this specification should be construed as requiring a specific three dimensional orientation of structures in order to fall within the scope of this invention, unless explicitly specified by the claims. Additionally, the term "plurality," as used herein, indicates any number greater than one, either disjunctively or conjunctively, as necessary, up to an infinite number. For quantitative values described herein that do not include decimal points, each digit to the left of the decimal point is considered to be a significant digit. Accordingly, while the specific embodiments have been illustrated and described, numerous modifications come to mind without significantly departing from the spirit of the invention and the scope of protection is only limited by the scope of the accompanying claims.

What is claimed is:

1. A bag configured to be filled with a filler material, comprising:

a shell comprising a cylindrical portion, a first end, and a second end opposite the first end, wherein the cylindrical portion, the first end and the second end of the shell combine to define and enclose an inner cavity configured to contain the filler material, and wherein the shell has an opening providing access to the inner cavity for filling the filler material into the inner cavity; and a handle assembly comprising:

a handle configured to be grasped by a user;

a first circumferential strap engaged with the handle and extending from a first handle end to engage the shell, wherein the first circumferential strap extends circumferentially around at least a first portion of the cylindrical portion;

a second circumferential strap engaged with the handle and extending from a second handle end to engage the shell, wherein the second circumferential strap extends circumferentially around at least a second portion of the cylindrical portion of the shell; and a central strap extending from the first handle end around the first end of the cylindrical portion, and extending from the second handle end around the second end of the cylindrical portion, and further extending longitudinally across a third portion of the cylindrical portion, between the first and second ends, to engage the shell.

2. The bag of claim 1, further comprising an inner bag positioned in the inner cavity and connected to an inner surface of the shell, wherein the inner bag is in communication with the opening and is configured to be filled with the filler material through the opening.

3. The bag of claim 1, wherein the handle is positioned on a top of the shell, and the central strap extends longitudinally across a bottom of the shell, opposite the top of the shell.

4. The bag of claim 1, wherein the first cylindrical strap, the second cylindrical strap, and the central strap non-fixedly engage the shell and are moveable with respect to the shell.

5. The bag of claim 1, wherein the first cylindrical strap comprises a first strap portion extending in a first peripheral direction from the handle and a second strap portion extending in a second peripheral direction from the handle that is opposite to the first peripheral direction.

6. The bag of claim 1, wherein the first end of the shell comprises:

a first outer panel on an outer surface of the shell; and a first inner panel on an inner surface of the shell;

wherein the second end of the shell comprises:

a second outer panel on an outer surface of the shell; and a second inner panel on an inner surface of the shell, wherein the central strap passes between the first outer panel and the first inner panel, and the central strap passes between the second outer panel and the second inner panel.

7. The bag of claim 6, further comprising:

a first slot defined between the first outer panel and the first inner panel; and a second slot defined between the second outer panel and the second inner panel, wherein the central strap extends through the first slot and the second slot to retain the central strap in non-fixed engagement with the shell.

8. The bag of claim 1, wherein the first end of the shell has a first slot and the second end of the shell has a second slot, and wherein the central strap extends through the first slot and the second slot to retain the central strap in non-fixed engagement with the shell.

9. The bag of claim 8, wherein the central strap includes a first central strap portion extending from the first handle end around the first end of the shell and through the first slot and at least partially across a bottom of the shell, and a second central strap portion extending from the second handle end around the second end of the shell and through the second slot and at least partially across the bottom of the shell.

10. The bag of claim 9, wherein the first central strap portion and the second central strap portion are connected at a joint spaced from the handle to form the central strap.

11. The bag of claim 9, wherein the first central strap portion and the second central strap portion are formed as a single, integral strap that extends through the handle from the first handle end to the second handle end.

12. A bag configured to be filled with a filler material, comprising:

a shell comprising a cylindrical portion having a circular cylindrical shape and opposed first and second ends connected to the cylindrical portion and each having a circular shape, wherein the cylindrical portion and the first and second ends of the shell combine to define and enclose an inner cavity configured to contain the filler material, wherein the first end includes a first outer panel on an outer surface of the shell and a first inner panel on an inner surface of the shell, with a first slot defined between the first inner panel and the first outer panel, wherein the second end includes a second outer panel on the outer surface of the shell and a second inner panel on the inner surface of the shell, with a second slot defined between the second inner panel and second outer panel, and wherein the shell has an opening providing access to the inner cavity for filling the filler material into the inner cavity; and a handle assembly comprising:

a handle configured to be grasped by a user and having first and second opposed handle ends; and a central strap engaging the handle and extending from the first handle end through the first slot and around the first end of the shell, and extending from the second handle end through the second slot and around the second end of the shell, the central strap further extending longitudinally across the shell between the first end and the second end, wherein the central strap extending through the first and second slots retains the central strap in non-fixed engagement with the shell.

13. The bag of claim 12, wherein the central strap comprises a first strap portion extending at least partially across a bottom of the shell, and a second strap portion extending at least partially across the bottom of the shell.

14. The bag of claim 13, wherein the first and second strap portions are connected at a joint to form the central strap.

15. The bag of claim 13, wherein the first strap portion and the second strap portion are separately engaged with the handle.

16. The bag of claim 13, wherein the first strap portion and the second strap portion are formed as a single, integral strap that extends through the handle from the first handle end to the second handle end.

17. The bag of claim 12, wherein the central strap extends between the first inner panel and the first outer panel and between the second inner panel and the second outer panel.

18. The bag of claim 12, further comprising:

a circumferential strap engaged with the handle and extending from the first handle end to engage the shell, wherein the circumferential strap extends circumferentially around at least a first portion of the cylindrical portion.

19. A bag configured to be filled with a filler material, comprising:

a shell comprising a cylindrical portion, a first end, and a second end opposite the first end, wherein the cylindrical portion, the first end and the second end of the shell combine to define and enclose an inner cavity configured to contain the filler material; and a handle assembly comprising:

a handle configured to be grasped by a user;

a peripheral strap wherein the peripheral strap extends from a first end of the handle in a first peripheral direction around a first periphery of the cylindrical portion proximate the first end to engage the shell and returns to the first end of the handle, and extends from a second end of the handle in a second peripheral direction around a second periphery of the cylindrical portion proximate to the second end to engage the shell; and a central strap extending from the handle transverse to the first peripheral direction and the second peripheral direction around the first end, a portion of the cylindrical portion, and the second end to engage the shell.

20. The bag of claim 19, wherein the central strap extends through a first slot defined by an inner surface and an outer surface of the first end and through a second slot defined by an inner surface and an outer surface of the second end.

21. The bag of claim 20, wherein the central strap is movably engaged with the shell.

* * * * *